US011492688B2

(12) United States Patent
Yoshida et al.

(10) Patent No.: US 11,492,688 B2
(45) Date of Patent: Nov. 8, 2022

(54) STEEL MATERIAL SUITABLE FOR USE IN SOUR ENVIRONMENT

(71) Applicant: NIPPON STEEL CORPORATION, Tokyo (JP)

(72) Inventors: Shinji Yoshida, Tokyo (JP); Yuji Arai, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 17/253,229

(22) PCT Filed: Sep. 26, 2019

(86) PCT No.: PCT/JP2019/037747
§ 371 (c)(1),
(2) Date: Dec. 17, 2020

(87) PCT Pub. No.: WO2020/071217
PCT Pub. Date: Apr. 9, 2020

(65) Prior Publication Data

US 2021/0269902 A1 Sep. 2, 2021

(30) Foreign Application Priority Data

Oct. 4, 2018 (JP) ..... JP2018-188777
Oct. 4, 2018 (JP) ..... JP2018-188841
Oct. 4, 2018 (JP) ..... JP2018-188868

(51) Int. Cl.
*C22C 38/32* (2006.01)
*C22C 38/00* (2006.01)
(Continued)

(52) U.S. Cl.
CPC ..... *C22C 38/32* (2013.01); *C21D 8/105* (2013.01); *C22C 38/001* (2013.01); *C22C 38/02* (2013.01);
(Continued)

(58) Field of Classification Search
None
See application file for complete search history.

(56) References Cited

U.S. PATENT DOCUMENTS

2007/0137736 A1 6/2007 Omura et al.
2012/0186704 A1 7/2012 Eguchi et al.
2020/0040436 A1 2/2020 Arai et al.

FOREIGN PATENT DOCUMENTS

JP 2000256783 A 9/2000
JP 2000297344 A 10/2000
(Continued)

OTHER PUBLICATIONS

Kondo Kunio et al.; Machine translation of JP 2000-297344; Oct. 24, 2000.

*Primary Examiner* — Anthony M Liang
(74) *Attorney, Agent, or Firm* — Greer, Burns & Crain, Ltd.

(57) ABSTRACT

The steel material according to the present disclosure has a chemical composition consisting of, in mass %, C: 0.20 to 0.35%, Si: 0.05 to 1.00%, Mn: 0.01 to 1.00%, P: 0.025% or less, S: 0.0100% or less, Al: 0.005 to 0.100%, Cr 0.25 to 0.80%, Mo: 0.20 to 2.00%, Ti: 0.002 to 0.050%, B: 0.0001 to 0.0050%, N: 0.0020 to 0.0100% and O: 0.0100% or less, with the balance being Fe and impurities, and satisfying Formula (1). A number density of precipitates having an equivalent circular diameter of 400 nm or more is 0.150 particles/$\mu m^2$ or less. The yield strength is within a range of 655 to 965 MPa. A dislocation density ρ is $7.0\times10^{14}$ $m^{-2}$ or less.

$$5\times Cr - Mo - 2\times(V+Ti) \leq 3.00 \quad (1)$$

10 Claims, 2 Drawing Sheets

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/28*** | (2006.01) |
| ***C21D 8/10*** | (2006.01) |

(52) U.S. Cl.
CPC ..... *C22C 38/04* (2013.01); *C22C 38/06* (2013.01); *C22C 38/22* (2013.01); *C22C 38/28* (2013.01)

(56) References Cited

FOREIGN PATENT DOCUMENTS

| | | | |
|---|---|---|---|
| JP | 2005350754 | A | 12/2005 |
| JP | 2012026030 | A | 2/2012 |
| WO | 2010150915 | A1 | 12/2010 |
| WO | 2018066689 | A1 | 4/2018 |

STEEL MATERIAL SUITABLE FOR USE IN SOUR ENVIRONMENT

This is a National Phase Application filed under 35 U.S.C. § 371, of International Application No. PCT/JP2019/037747, filed Sep. 26, 2019, the contents of which are incorporated by reference.

TECHNICAL FIELD

The present invention relates to a steel material, and more particularly relates to a steel material suitable for use in a sour environment.

BACKGROUND ART

Due to the deepening of oil wells and gas wells (hereunder, oil wells and gas wells are collectively referred to as "oil wells"), there is a demand to enhance the strength of oil-well steel materials represented by oil-well steel pipes. Specifically, 80 ksi grade (yield strength is 80 to less than 95 ksi, that is, 552 to less than 655 MPa) and 95 ksi grade (yield strength is 95 to less than 110 ksi, that is, 655 to less than 758 MPa) oil-well steel pipes are being widely utilized, and recently requests are also starting to be made for 110 ksi grade (yield strength is 110 to less than 125 ksi, that is, 758 to less than 862 MPa) and 125 ksi grade (yield strength is 125 ksi to 140 ksi, that is, 862 to 965 MPa) oil-well steel pipes.

Most deep wells are in a sour environment containing corrosive hydrogen sulfide. In the present description, the term "sour environment" means an acidified environment containing hydrogen sulfide. Note that, in some cases a sour environment may also contain carbon dioxide. Oil-well steel pipes for use in such sour environments are required to have not only high strength, but to also have sulfide stress cracking resistance (hereunder, referred to as "SSC resistance").

In addition, in recent years, deep wells beneath the surface of the sea are also being actively developed. For example, in so-called "deep-sea offshore oil fields" that are at a water depth of 2000 m or more, the water temperature is low. In such a case, SSC resistance in a low-temperature environment is also required. However, normally, the sulfide stress cracking susceptibility of a steel material increases as the environmental temperature decreases. Therefore, a steel material for oil wells, as typified by an oil-well steel pipe, which has high strength and also has excellent SSC resistance in a low-temperature sour environment has started to be demanded.

Technology for enhancing the SSC resistance of steel materials as typified by oil-well steel pipes is disclosed in Japanese Patent Application Publication No. 2000-256783 (Patent Literature 1), Japanese Patent Application Publication No. 2000-297344 (Patent Literature 2), Japanese Patent Application Publication No. 2005-350754 (Patent Literature 3), Japanese Patent Application Publication No. 2012-26030 (Patent Literature 4), and International Application Publication No. WO 2010/150915 (Patent Literature 5).

A high-strength oil-well steel disclosed in Patent Literature 1 contains, in weight %, C: 0.2 to 0.35%, Cr: 0.2 to 0.7%, Mo: 0.1 to 0.5% and V: 0.1 to 0.3%. The amount of precipitating carbides is within the range of 2 to 5 weight percent, and among the precipitating carbides the proportion of MC-type carbides is within the range of 8 to 40 weight percent, and the prior-austenite grain size is No. 11 or higher in terms of the grain size numbers defined in ASTM. It is described in Patent Literature 1 that the aforementioned high-strength oil-well steel is excellent in toughness and sulfide stress corrosion cracking resistance.

A steel for oil wells that is disclosed in Patent Literature 2 is a low-alloy steel containing, in mass %, C: 0.15 to 0.3%, Cr: 0.2 to 1.5%, Mo: 0.1 to 1%, V: 0.05 to 0.3% and Nb: 0.003 to 0.1%. The amount of precipitating carbides is within the range of 1.5 to 4% by mass, the proportion that MC-type carbides occupy among the amount of carbides is within the range of 5 to 45% by mass, and when the wall thickness of the product is taken as t (mm), the proportion of $M_{23}C_6$-type carbides is (200/t) or less in percent by mass. It is described in Patent Literature 2 that the aforementioned steel for oil wells is excellent in toughness and sulfide stress corrosion cracking resistance.

A steel for low-alloy oil country tubular goods disclosed in Patent Literature 3 contains, in mass %, C: 0.20 to 0.35%, Si: 0.05 to 0.5%, Mn: 0.05 to 1.0%, P: 0.025% or less, S: 0.010% or less, Al: 0.005 to 0.10%, Cr: 0.1 to 1.0%, Mo: 0.5 to 1.0%, Ti: 0.002 to 0.05%, V: 0.05 to 0.3%, B: 0.0001 to 0.005%, N: 0.01% or less and O (oxygen): 0.01% or less. A half-value width H and a hydrogen diffusion coefficient D ($10^{-6}$ $cm^2/s$) satisfy the expression ($30H+D \leq 19.5$). It is described in Patent Literature 3 that the aforementioned steel for low-alloy oil country tubular goods has excellent SSC resistance even when the steel has high strength with a yield stress (YS) of 861 MPa or more.

An oil-well steel pipe disclosed in Patent Literature 4 has a composition consisting of, in mass %, C: 0.18 to 0.25%, Si: 0.1 to 0.3%, Mn: 0.4 to 0.8%, P: 0.015% or less, S: 0.005% or less, Al: 0.01 to 0.1%, Cr: 0.3 to 0.8%, Mo: 0.5 to 1.0%, Nb: 0.003 to 0.015%, Ti: 0.002 to 0.05% and B: 0.003% or less, with the balance being Fe and unavoidable impurities. In the microstructure of the aforementioned oil-well steel pipe, a tempered martensite phase is the main phase, the number of $M_3C$ or $M_2C$ included in a region of 20 μm×20 μm and having an aspect ratio of 3 or less and a major axis of 300 nm or more when the carbide shape is taken as elliptical is not more than 10, the content of $M_{23}C_6$ is less than 1% by mass, acicular $M_2C$ precipitates inside the grains, and the amount of Nb precipitating as carbides having a size of 1 μm or more is less than 0.005% by mass. It is described in Patent Literature 4 that the aforementioned oil-well steel pipe is excellent in sulfide stress cracking resistance even when the yield strength is 862 MPa or more.

A seamless steel pipe for oil wells disclosed in Patent Literature 5 has a composition consisting of, in mass %, C: 0.15 to 0.50%, Si: 0.1 to 1.0%, Mn: 0.3 to 1.0%, P: 0.015% or less, S: 0.005% or less, Al: 0.01 to 0.1%, N: 0.01% or less, Cr: 0.1 to 1.7%, Mo: 0.4 to 1.1%, V: 0.01 to 0.12%, Nb: 0.01 to 0.08% and B: 0.0005 to 0.003%, in which the proportion of Mo that is contained as dissolved Mo is 0.40% or more, with the balance being Fe and unavoidable impurities. In the microstructure of the aforementioned seamless steel pipe for oil wells, a tempered martensite phase is the main phase, the grain size number of prior-austenite grains is 8.5 or higher, and substantially particulate $M_2C$-type precipitates are dispersed in an amount of 0.06% by mass or more. It is described in Patent Literature 5 that the aforementioned seamless steel pipe for oil wells has both a high strength of 110 ksi grade and excellent sulfide stress cracking resistance.

CITATION LIST

Patent Literature

Patent Literature 1: Japanese Patent Application Publication No. 2000-256783

Patent Literature 2: Japanese Patent Application Publication No. 2000-297344

Patent Literature 3: Japanese Patent Application Publication No. 2005-350754

Patent Literature 4: Japanese Patent Application Publication No. 2012-26030

Patent Literature 5: International Application Publication No. WO 2010/150915

SUMMARY OF INVENTION

Technical Problem

However, even if the techniques disclosed in the aforementioned Patent Literatures 1 to 5 are applied, in the case of a steel material (for example, an oil-well steel pipe) having a yield strength of 95 to 125 ksi grade (655 to 965 MPa), in some cases excellent SSC resistance cannot be stably obtained in a low-temperature sour environment.

An objective of the present disclosure is to provide a steel material that has a yield strength within a range of 655 to 965 MPa (95 to 140 ksi, 95 to 125 ksi grade), and also has excellent SSC resistance in a normal-temperature sour environment and a low-temperature sour environment.

Solution to Problem

A steel material according to the present disclosure has a chemical composition consisting of, in mass %, C: 0.20 to 0.35%, Si: 0.05 to 1.00%, Mn: 0.01 to 1.00%, P: 0.025% or less, S: 0.0100% or less, Al: 0.005 to 0.100%, Cr: 0.25 to 0.80%, Mo: 0.20 to 2.00%, Ti: 0.002 to 0.050%, B: 0.0001 to 0.0050%, N: 0.0020 to 0.0100%, O: 0.0100% or less, V: 0 to 0.60%, Nb: 0 to 0.030%, Ca: 0 to 0.0100%, Mg: 0 to 0.0100%, Zr: 0 to 0.0100%, Co: 0 to 0.50%, W: 0 to 0.50%, Ni: 0 to 0.50%, Cu: 0 to 0.50% and rare earth metal: 0 to 0.0100%, with the balance being Fe and impurities, and satisfying Formula (1). In the steel material according to the present disclosure, a number density of precipitates having an equivalent circular diameter of 400 nm or more is 0.150 particles/$\mu m^2$ or less. In the steel material according to the present disclosure, the yield strength is within a range of 655 to 965 MPa. In the steel material according to the present disclosure, a dislocation density $\rho$ is $7.0\times10^{14}$ $m^{-2}$ or less.

In a case where the yield strength is within a range of 655 to less than 758 MPa, the dislocation density $\rho$ is $1.4\times10^{14}$ $m^{-2}$ or less.

In a case where the yield strength is within a range of 758 to less than 862 MPa, the dislocation density $\rho$ is within a range of more than $1.4\times10^{14}$ to less than $3.0\times10^{14}$ $m^{-2}$.

In a case where the yield strength is within a range of 862 to 965 MPa, the dislocation density $\rho$ is within a range of $3.0\times10^{14}$ to $7.0\times10^{14}$ $m^{-2}$.

$$5\times Cr—Mo-2\times(V+Ti)\leq 3.00 \quad (1)$$

where, a content (mass %) of a corresponding element is substituted for each symbol of an element in Formula (1). If a corresponding element is not contained, "0" is substituted for the symbol of the relevant element.

Advantageous Effects of Invention

The steel material according to the present disclosure has a yield strength within a range of 655 to 965 MPa (95 to 125 ksi grade), and has excellent SSC resistance in a normal-temperature sour environment and a low-temperature sour environment.

DESCRIPTION OF EMBODIMENTS

Figure 1:
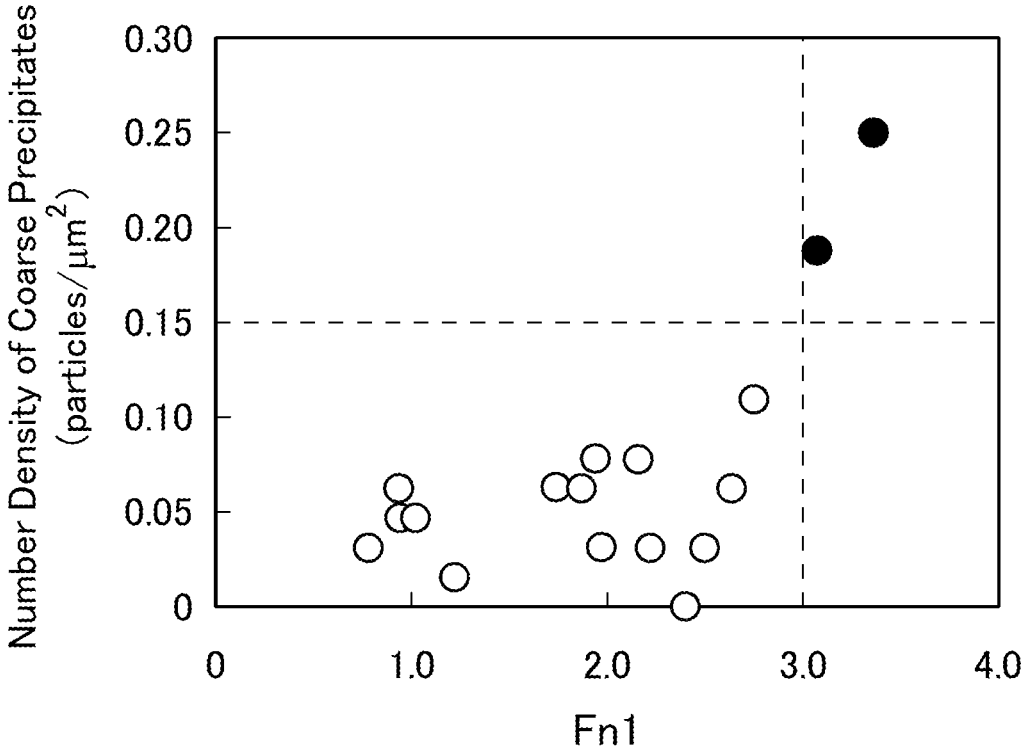
FIG. 1 is a view that illustrates the relation between Fn1 and a number density of coarse precipitates for the steel materials having a yield strength of 95 ksi grade.

The present inventors conducted investigations and studies regarding a method for enhancing SSC resistance in a normal-temperature sour environment and a low-temperature sour environment while maintaining a yield strength within a range of 655 to 965 MPa (95 to 125 ksi grade) in a steel material that will assumedly be used in a low-temperature sour environment. At a result, the present inventors considered that if a steel material has a chemical composition consisting of, in mass %, C: 0.20 to 0.35%, Si: 0.05 to 1.00%, Mn: 0.01 to 1.00%, P: 0.025% or less, S: 0.0100% or less, Al: 0.005 to 0.100%, Cr: 0.25 to 0.80%, Mo: 0.20 to 2.00%, Ti: 0.002 to 0.050%, B: 0.0001 to 0.0050%, N: 0.0020 to 0.0100%, O: 0.0100% or less, V: 0 to 0.60%, Nb: 0 to 0.030%, Ca: 0 to 0.0100%, Mg: 0 to 0.0100%, Zr: 0 to 0.0100%, Co: 0 to 0.50%, W: 0 to 0.50%, Ni: 0 to 0.50%, Cu: 0 to 0.50% and rare earth metal: 0 to 0.0100%, with the balance being Fe and impurities, there is a possibility that the SSC resistance of the steel material can be increased in a normal-temperature sour environment and a low-temperature sour environment while maintaining a yield strength of 95 to 125 ksi grade.

If the dislocation density in the steel material is increased, the yield strength of the steel material will increase. However, there is a possibility that dislocations will occlude hydrogen. Therefore, if the dislocation density of the steel material increases, there is a possibility that the amount of hydrogen that the steel material occludes will also increase. If the hydrogen concentration in the steel material increases as a result of increasing the dislocation density, even if high strength is obtained, the SSC resistance of the steel material will decrease. Accordingly, in order to obtain both a yield strength of 95 to 125 ksi grade and excellent SSC resistance, utilizing dislocation density to enhance the strength is not preferable.

Therefore, the present inventors first conducted studies regarding reducing the dislocation density of the steel material in a manner that takes into consideration increasing the SSC resistance. Specifically the present inventors first focused their attention on a yield strength in the range of 655 to less than 758 MPa (95 ksi grade), and conducted studies regarding reducing the dislocation density and increasing the SSC resistance of the steel material. As a result, the present inventors discovered that there is a possibility if the dislocation density of the steel material having the aforementioned chemical composition is reduced to $1.4\times10^{14}$ ($m^{-2}$) or less, the SSC resistance of the steel material increases while maintaining a yield strength of 95 ksi grade.

The present inventors also conducted studies in a similar manner with respect to cases where the yield strengths are different. Specifically the present inventors focused their attention on a yield strength in the range of 758 to less than 862 MPa (110 ksi grade), and conducted studies regarding reducing the dislocation density and increasing the SSC resistance of the steel material. As a result, the present inventors discovered that if the dislocation density of the steel material having the aforementioned chemical composition is reduced to less than $3\times10^{14}$ ($m^{-2}$), the SSC resistance of the steel material increases. Therefore, there is a possibility that the steel material has the aforementioned chemical composition and the dislocation density of within a range of more than $1.4\times10^{14}$ to less than $3\times10^{14}$ ($m^{-2}$), the SSC resistance of the steel material increases while maintaining a yield strength of 110 ksi grade.

The present inventors also focused their attention on a yield strength in the range of 862 to 965 MPa (125 ksi grade), and conducted studies regarding reducing the dislocation density and increasing the SSC resistance of the steel material. As a result, the present inventors discovered that if the dislocation density of the steel material having the aforementioned chemical composition is reduced to $7.0\times10^{14}$ ($m^{-2}$) or less, the SSC resistance of the steel material increases. Therefore, there is a possibility that the steel material has the aforementioned chemical composition and the dislocation density of within a range of $3.0\times10^{14}$ to $7.0\times10^{14}$ ($m^{-2}$), the SSC resistance of the steel material increases while maintaining a yield strength of 125 ksi grade.

Therefore, the steel material has the aforementioned chemical composition, and in addition to reducing the dislocation density in accordance with the yield strength that it is intended to obtain there is a possibility that both a yield strength and SSC resistance can be obtained in a normal-temperature sour environment and a low-temperature sour environment. Specifically, in the steel material having the aforementioned chemical composition, in a case where it is intended to obtain a yield strength of 95 ksi grade, the dislocation density is reduced to $1.4\times10^{14}$ ($m^{-2}$) or less, in a case where it is intended to obtain a yield strength of 110 ksi grade, the dislocation density is reduced to within a range of more than $1.4\times10^{14}$ to less than $3.0\times10^{14}$ ($m^{-2}$), in a case where it is intended to obtain a yield strength of 125 ksi grade, the dislocation density is reduced to within a range of $3\times10$ to $7.0\times10^{14}$ ($m^{-2}$), there is a possibility that the SSC resistance of the steel material can be increased in a normal-temperature sour environment and a low-temperature sour environment.

However, in the case of a steel material having the aforementioned chemical composition, as a result of reducing the dislocation density while maintaining the yield strength, excellent SSC resistance is not obtained in a low-temperature sour environment. Therefore, the present inventors conducted investigations and studies regarding the steel material having the aforementioned chemical composition and reducing the dislocation density while maintaining the yield strength. At the result, it was clarified that, in a case where a steel material did not exhibit excellent SSC resistance in a low-temperature sour environment, a large number of coarse precipitates precipitated in the steel material.

The present inventors consider that the reason why a steel material in which a large number of coarse precipitates precipitated does not exhibit excellent SSC resistance in a low-temperature sour environment as follows. As described above, the sulfide stress cracking susceptibility of a steel material increases in a low-temperature sour environment in comparison to a normal-temperature sour environment. Therefore, in the case of a steel material having the aforementioned chemical composition, it is considered that in a low-temperature sour environment, in some cases stress concentration at the interfaces between the coarse precipitates and the base metal is actualized and SSC occurs.

That is, with respect to the steel material having the aforementioned chemical composition, if coarse precipitates are reduced after having decreased the dislocation density while maintaining the yield strength, there is a possibility that both a yield strength within a range of 655 to 965 MPa (95 to 125 ksi grade) and excellent SSC resistance in a low-temperature sour environment can be obtained. Therefore, as coarse precipitates, the present inventors focused their attention specifically on precipitates having an equivalent circular diameter of 400 nm or more, and conducted studies regarding a method for reducing precipitates having an equivalent circular diameter of 400 nm or more.

First, the present inventors found that almost all of the precipitates having an equivalent circular diameter of 400 nm or more (hereunder, also referred to as "coarse precipitates") are carbides. Therefore, there is a possibility that the coarse precipitates can be reduced by adjusting the content of Cr, Mo, Ti and V that are alloying elements which easily form carbides. Therefore, the present inventors conducted detailed studies regarding the relation between the content of Cr, Mo, Ti and V and the number density of the coarse precipitates in a steel material having the aforementioned chemical composition.

Herein, it is defined that Fn1=5×Cr—Mo-2×(V+Ti). First, a steel material having a yield strength of 95 ksi grade will be described with reference to the drawing. FIG. 1 is a view that illustrates the relation between Fn1 and the number density of coarse precipitates for the steel materials having a yield strength of 95 ksi grade. FIG. 1 was created using Fn1, the number density of coarse precipitates (particles/$\mu m^2$) obtained by a method described later, and evaluation results of a low-temperature SSC resistance test that is described later, with respect to steel materials for which, among the steel materials of the examples that are described later, the yield strength was within the range of 655 to less than 758 MPa, the chemical composition was within the range of the present embodiment, and the dislocation density was $1.4\times10^{14}$ ($m^{-2}$) or less. Note that, the symbol "O" in FIG. 1 indicates a steel material for which the result of the low-temperature SSC resistance test was good. On the other hand, the symbol "●" in FIG. 1 indicates a steel material for which the result of the low-temperature SSC resistance test was not good.

Referring to FIG. 1, for steel materials having the aforementioned chemical composition, in which the dislocation density was $1.4\times10^{14}$ ($m^{-2}$) or less, and having a yield strength of 95 ksi grade, when Fn1 was 3.00 or less, the number density of coarse precipitates was 0.150 particles/$\mu m^2$ or less. As a result, even when the yield strength was within the range of 655 to less than 758 MPa (95 ksi grade), favorable results were exhibited in the low-temperature SSC resistance test. On the other hand, for steel materials having the aforementioned chemical composition and in which the dislocation density was $1.4\times10^{14}$ ($m^{-2}$) or less and the yield strength was 95 ksi grade, when Fn1 was more than 3.00, the number density of coarse precipitates was more than 0.150 particles/$\mu m^2$. As a result, although the yield strength was within the range of 655 to less than 758 MPa (95 ksi grade), favorable results were not exhibited in the low-temperature SSC resistance test.

Figure 2:
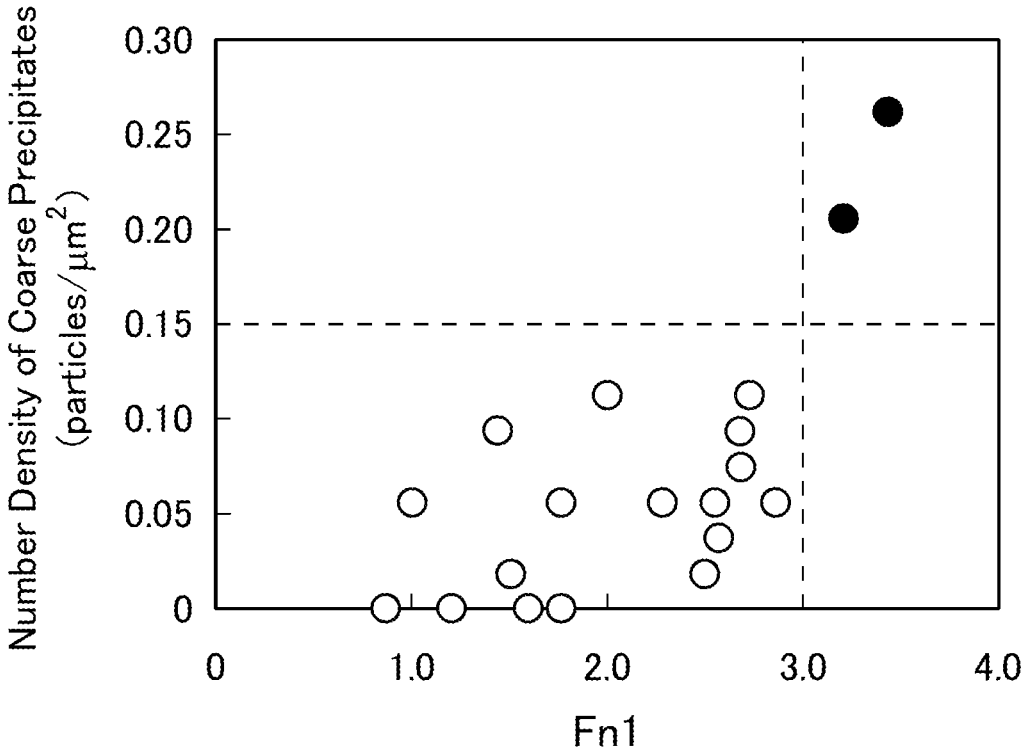
FIG. 2 is a view that illustrates the relation between Fn1 and a number density of coarse precipitates for the steel materials having a yield strength of 110 ksi grade.

Next, a steel material having a yield strength of 110 ksi grade will be described with reference to the drawing. FIG. 2 is a view that illustrates the relation between Fn1 and the number density of coarse precipitates for the steel materials having a yield strength of 110 ksi grade. FIG. 2 was created using Fn1, a number density of coarse precipitates (particles/$\mu m^2$) obtained by a method described later, and evaluation results of a low-temperature SSC resistance test that is described later, with respect to steel materials for which, among the steel materials of the examples that are described later, the yield strength was within the range of 758 to less than 862 MPa, the chemical composition was within the range of the present embodiment, and the dislocation density was within the range of more than $1.4\times10^{14}$ to less than $3.0\times10^{14}$ ($m^{-2}$). Note that, the symbol "○" in FIG. 2 indicates a steel material for which the result of the low-temperature SSC resistance test was good. On the other hand, the symbol "●" in FIG. 2 indicates a steel material for which the result of the low-temperature SSC resistance test was not good.

Referring to FIG. 2, for steel materials having the aforementioned chemical composition, in which the dislocation density was within the range of more than $1.4\times10^{14}$ to less than $3.0\times10^{14}$ ($m^{-2}$), and having a yield strength of 110 ksi grade, when Fn1 was 3.00 or less, the number density of coarse precipitates was 0.150 particles/$\mu m^2$ or less. As a result, even when the yield strength was within the range of 758 to less than 862 MPa (110 ksi grade), favorable results were exhibited in the low-temperature SSC resistance test. On the other hand, for steel materials having the aforementioned chemical composition and in which the dislocation density was within the range of more than $1.4\times10^{14}$ to less than $3.0\times10^{14}$ ($m^{-2}$) and the yield strength was 110 ksi grade, when Fn1 was more than 3.00, the number density of coarse precipitates was more than 0.150 particles/$\mu m^2$. As a result, although the yield strength was within the range of 758 to less than 862 MPa (110 ksi grade), favorable results were not exhibited in the low-temperature SSC resistance test.

Figure 3:
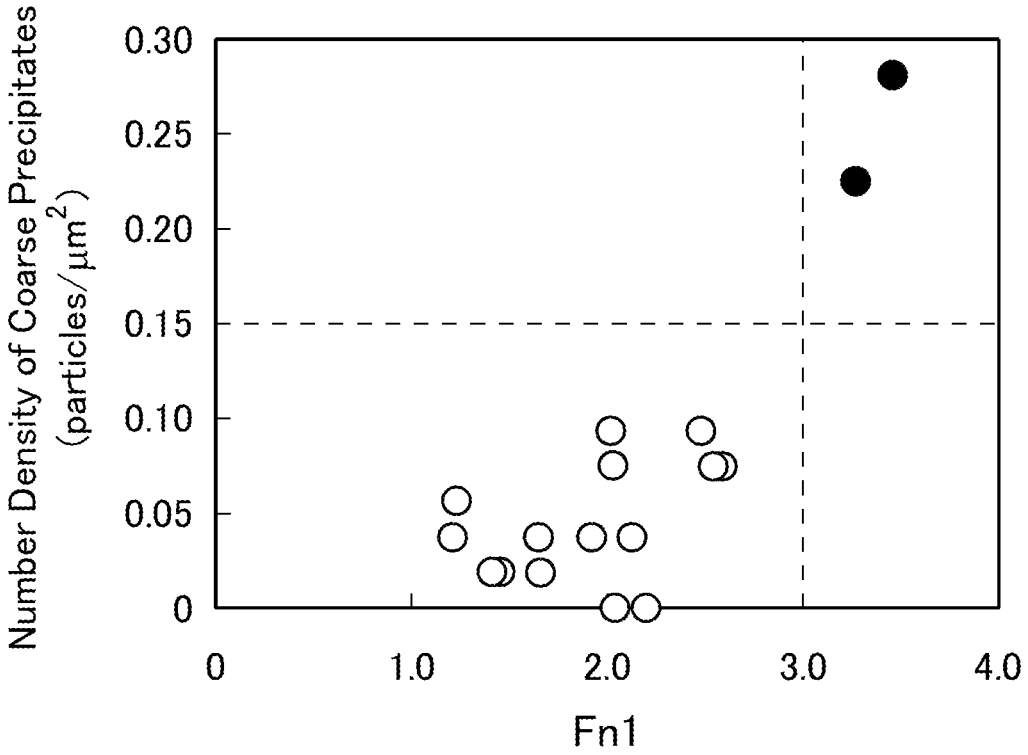
FIG. 3 is a view that illustrates the relation between Fn1 and a number density of coarse precipitates for the steel materials having a yield strength of 125 ksi grade.

Similarly, a steel material having a yield strength of 125 ksi grade will be described with reference to the drawing. FIG. 3 is a view that illustrates the relation between Fn1 and the number density of coarse precipitates for the steel materials having a yield strength of 125 ksi grade. FIG. 3 was created using Fn1, a number density of coarse precipitates (particles/$\mu m^2$) obtained by a method described later, and evaluation results of a low-temperature SSC resistance test that is described later, with respect to steel materials for which, among the steel materials of the examples that are described later, the yield strength was within the range of 862 to 965 MPa, the chemical composition was within the range of the present embodiment, and the dislocation density was within the range of $3.0\times10^{14}$ to $7.0\times10^{14}$ ($m^{-2}$). Note that, the symbol "○" in FIG. 3 indicates a steel material for which the result of the low-temperature SSC resistance test was good. On the other hand, the symbol "●" in FIG. 3 indicates a steel material for which the result of the low-temperature SSC resistance test was not good.

Referring to FIG. 3, for steel materials having the aforementioned chemical composition, in which the dislocation density was within the range of $3.0\times10^{14}$ to $7.0\times10^{14}$ ($m^{-2}$), and having a yield strength of 125 ksi grade, when Fn1 was 3.00 or less, the number density of coarse precipitates was 0.150 particles/$\mu m^2$ or less. As a result, even when the yield strength was within the range of 862 to 965 MPa (125 ksi grade), favorable results were exhibited in the low-temperature SSC resistance test. On the other hand, for steel materials having the aforementioned chemical composition and in which the dislocation density was within the range of $3.0\times10^{14}$ to $7.0\times10^{14}$ ($m^{-2}$) and the yield strength was 125 ksi grade, when Fn1 was more than 3.00, the number density of coarse precipitates was more than 0.150 particles/$\mu m^2$. As a result, although the yield strength was within the range of 862 to 965 MPa (125 ksi grade), favorable results were not exhibited in the low-temperature SSC resistance test.

Thus, the steel material has the aforementioned chemical composition, and in addition to reducing the dislocation density in accordance with the yield strength (95 ksi grade, 110 ksi grade and 125 ksi grade) that it is intended to obtain, furthermore, Fn1 is made 3.00 or less, the number density of precipitates having an equivalent circular diameter of 400 nm or more in the steel material is 0.150 particles/$\mu m^2$ or less. As a result, even when the yield strength is within the range of 655 to 965 MPa (95 to 125 ksi grade), excellent SSC resistance can be obtained in a low-temperature sour environment. Note that, in the present description, the term "equivalent circular diameter" means the diameter of a circle in a case where the area of a precipitate observed on a visual field surface during micro-structure observation is converted into a circle having the same area.

A steel material according to the present embodiment that was completed based on the above findings has a chemical composition consisting of, in mass %, C: 0.20 to 0.35%, Si: 0.05 to 1.00%, Mn: 0.01 to 1.00%, P: 0.025% or less, S: 0.0100% or less, Al: 0.005 to 0.100%, Cr: 0.25 to 0.80%, Mo: 0.20 to 2.00%, Ti: 0.002 to 0.050%, B: 0.0001 to 0.0050%, N: 0.0020 to 0.0100%, O: 0.0100% or less, V: 0 to 0.60%, Nb: 0 to 0.030%, Ca: 0 to 0.0100%, Mg: 0 to 0.0100%, Zr: 0 to 0.0100%, Co: 0 to 0.50%, W: 0 to 0.50%, Ni: 0 to 0.50%, Cu: 0 to 0.50% and rare earth metal: 0 to 0.0100%, with the balance being Fe and impurities, and satisfying Formula (1). In the steel material, a number density of precipitates having an equivalent circular diameter of 400 nm or more is 0.150 particles/$\mu m^2$ or less. The yield strength is within a range of 655 to 965 MPa. A dislocation density $\rho$ is $7.0\times10^{14}$ $m^{-2}$ or less. In a case where the yield strength is within a range of 655 to less than 758 MPa, the dislocation density $\rho$ is $1.4\times10^{14}$ $m^{-2}$ or less.

In a case where the yield strength is within a range of 758 to less than 862 MPa, the dislocation density $\rho$ is within a range of more than $1.4\times10^{14}$ to less than $3.0\times10^{14}$ $m^{-2}$.

In a case where the yield strength is within a range of 862 to 965 MPa, the dislocation density $\rho$ is within a range of $3.0\times10^{14}$ to $7.0\times10^{14}$ $m^{-2}$.

$$5\times Cr—Mo-2\times(V+Ti)\leq 3.00 \quad (1)$$

where, a content (mass %) of a corresponding element is substituted for each symbol of an element in Formula (1). If a corresponding element is not contained, "0" is substituted for the symbol of the relevant element.

In the present description, although not particularly limited, the steel material is, for example, a steel pipe or a steel plate.

The steel material according to the present embodiment has a yield strength of 655 to 965 MPa (95 to 125 ksi grade), and exhibits excellent SSC resistance in a normal-temperature sour environment and a low-temperature sour environment.

The aforementioned chemical composition may contain one or more types of element selected from the group consisting of V: 0.01 to 0.60% and Nb: 0.002 to 0.030%.

The aforementioned chemical composition may contain one or more types of element selected from the group consisting of Ca: 0.0001 to 0.0100%, Mg: 0.0001 to 0.0100% and Zr: 0.0001 to 0.0100%.

The aforementioned chemical composition may contain one or more types of element selected from the group consisting of Co: 0.02 to 0.50% and W: 0.02 to 0.50%.

The aforementioned chemical composition may contain one or more types of element selected from a group consisting of Ni: 0.01 to 0.50% and Cu: 0.01 to 0.50%.

The aforementioned chemical composition may contain a rare earth metal in an amount of 0.0001 to 0.0100%.

In the aforementioned steel material, the yield strength may be within a range of 655 to less than 758 MPa, the dislocation density ρ may be $1.4\times10^{14}$ $m^{-2}$ or less.

In the aforementioned steel material, the yield strength may be within a range of 758 to less than 862 MPa, the dislocation density ρ may be within a range of more than $1.4\times10^{14}$ to less than $3.0\times10^{14}$ $m^{-2}$.

In the aforementioned steel material, the yield strength may be within a range of 862 to 965 MPa, and the dislocation density ρ may be within a range of $3.0\times10^{14}$ to $7.0\times10^{14}$ $m^{-2}$.

The aforementioned steel material may be an oil-well steel pipe.

In the present description, the oil-well steel pipe may be a steel pipe that is used for a line pipe or may be a steel pipe used for oil country tubular goods. The shape of the oil-well steel pipe is not limited, and for example, the oil-well steel pipe may be a seamless steel pipe or may be a welded steel pipe. The oil country tubular goods are, for example, steel pipes that are used for use in casing or tubing.

Preferably, an oil-well steel pipe according to the present embodiment is a seamless steel pipe. If the oil-well steel pipe according to the present embodiment is a seamless steel pipe, even when the wall thickness thereof is 15 mm or more, the oil-well steel pipe has a yield strength within a range of 655 to 965 MPa (95 to 125 ksi grade), and has excellent SSC resistance in a normal-temperature sour environment and a low-temperature sour environment. In the present description, the term "normal-temperature sour environment" means a sour environment with a temperature of 10 to 30° C. In the present description, the term "low-temperature sour environment" means a sour environment with a temperature of less than 10° C.

Hereunder, the steel material according to the present invention is described in detail. The symbol "%" in relation to an element means "mass percent" unless specifically stated otherwise.

[Chemical Composition]

The chemical composition of the steel material according to the present invention contains the following elements.

C: 0.20 to 0.35%

Carbon (C) enhances the hardenability of the steel material and increases the yield strength of the steel material. C also promotes spheroidization of carbides during tempering in the production process, and thereby enhances the SSC resistance of the steel material. If carbides are dispersed, the yield strength of the steel material increases further. These effects will not be obtained if the C content is too low. On the other hand, if the C content is too high, the toughness of the steel material will decrease and quench cracking is liable to occur. In addition, if the C content is too high, coarse carbides will be formed in the steel material, and the SSC resistance of the steel material will decrease. Therefore, the C content is within the range of 0.20 to 0.35%. A preferable lower limit of the C content is 0.22%, and more preferably is 0.24%. A preferable upper limit of the C content is 0.33%, more preferably is 0.32%, further preferably is 0.30%, and further preferably is 0.29%.

Si: 0.05 to 1.00%

Silicon (Si) deoxidizes steel. If the Si content is too low, this effect is not obtained. On the other hand, if the Si content is too high, the SSC resistance of the steel material decreases. Therefore, the Si content is within the range of 0.05 to 1.00%. A preferable lower limit of the Si content is 0.15%, and more preferably is 0.20%. A preferable upper limit of the Si content is 0.85%, and more preferably is 0.70%.

Mn: 0.01 to 1.00%

Manganese (Mn) deoxidizes steel. Mn also enhances the hardenability of the steel material, and increases the yield strength of the steel material. If the Mn content is too low, these effects are not obtained. On the other hand, if the Mn content is too high, Mn segregates at grain boundaries together with impurities such as P and S. In such a case, the SSC resistance of the steel material will decrease. Therefore, the Mn content is within a range of 0.01 to 1.00%. A preferable lower limit of the Mn content is 0.02%, and more preferably is 0.03%. A preferable upper limit of the Mn content is 0.90%, and more preferably is 0.80%.

P: 0.025% or Less

Phosphorous (P) is an impurity. That is, the P content is more than 0%. P segregates at the grain boundaries and decreases the SSC resistance of the steel material. Therefore, the P content is 0.025% or less. A preferable upper limit of the P content is 0.020%, and more preferably is 0.015%. Preferably, the P content is as low as possible. However, if the P content is excessively reduced, the production cost increases significantly. Therefore, when taking industrial production into consideration, a preferable lower limit of the P content is 0.0001%, more preferably is 0.0003%, further preferably is 0.001%, and further preferably is 0.002%.

S: 0.0100% or Less

Sulfur (S) is an impurity. That is, the S content is more than 0%. S segregates at the grain boundaries and decreases the SSC resistance of the steel material. Therefore, the S content is 0.0100% or less. A preferable upper limit of the S content is 0.0050%, and more preferably is 0.0030%. Preferably, the S content is as low as possible. However, if the S content is excessively reduced, the production cost increases significantly. Therefore, when taking industrial production into consideration, a preferable lower limit of the S content is 0.0001%, and more preferably is 0.0003%.

Al: 0.005 to 0.100%

Aluminum (Al) deoxidizes steel. If the Al content is too low, this effect is not obtained and the SSC resistance of the steel material decreases. On the other hand, if the Al content is too high, coarse oxide-based inclusions are formed and the SSC resistance of the steel material decreases. Therefore, the Al content is within a range of 0.005 to 0.100%. A preferable lower limit of the Al content is 0.015%, and more preferably is 0.020%. A preferable upper limit of the Al content is 0.080%, and more preferably is 0.060%. In the present description, the "Al" content means "acid-soluble Al", that is, the content of "sol. Al".

Cr: 0.25 to 0.80%

Chromium (Cr) enhances the hardenability of the steel material, and increases the yield strength of the steel material. Cr also increases temper softening resistance and enables high-temperature tempering. As a result, the SSC resistance of the steel material increases. If the Cr content is too low, these effects are not obtained. On the other hand, if the Cr content is too high, coarse carbides will be formed in the steel material, and the SSC resistance of the steel material will decrease. Therefore, the Cr content is within a range of 0.25 to 0.80%. A preferable lower limit of the Cr content is 0.30%, more preferably is 0.35%, and further preferably is 0.40%. A preferable upper limit of the Cr content is 0.78%, and more preferably is 0.76%.

Mo: 0.20 to 2.00%

Molybdenum (Mo) enhances the hardenability of the steel material, and increases the yield strength of the steel material. Mo also forms fine carbides and thereby increases the temper softening resistance of the steel material. As a result, the SSC resistance of the steel material increases. If the Mo content is too low, these effects are not obtained. On the other hand, if the Mo content is too high, the aforementioned effects are saturated. Therefore, the Mo content is within a range of 0.20 to 2.00%. A preferable lower limit of the Mo content is 0.30%, more preferably is 0.40%, further preferably is 0.50%, further preferably is 0.60%, and further preferably is 0.61%. A preferable upper limit of the Mo content is 1.80%, more preferably is 1.70%, and further preferably is 1.50%.

Ti: 0.002 to 0.050%

Titanium (Ti) forms nitrides, and refines crystal grains by the pinning effect. By this means, the yield strength of the steel material increases. If the Ti content is too low, this effect is not obtained. On the other hand, if the Ti content is too high, Ti nitrides coarsen and the SSC resistance of the steel material decreases. Therefore, the Ti content is within a range of 0.002 to 0.050%. A preferable lower limit of the Ti content is 0.003%, and more preferably is 0.005%. A preferable upper limit of the Ti content is 0.030%, and more preferably is 0.020%.

B: 0.0001 to 0.0050%

Boron (B) dissolves in steel, enhances the hardenability of the steel material and increases the steel material strength. If the B content is too low, this effect is not obtained. On the other hand, if the B content is too high, coarse nitrides form and the SSC resistance of the steel material decreases. Therefore, the B content is within a range of 0.0001 to 0.0050%. A preferable lower limit of the B content is 0.0003%, and more preferably is 0.0007%. A preferable upper limit of the B content is 0.0030%, more preferably is 0.0025%, and further preferably is 0.0015%.

N: 0.0020 to 0.0100%

Nitrogen (N) combines with Ti to form fine nitrides and thereby refines the grains. If the N content is too low, this effect is not obtained. On the other hand, if the N content is too high, coarse nitrides form and the SSC resistance of the steel material decreases. Therefore, the N content is within the range of 0.0020 to 0.0100%. A preferable lower limit of the N content is 0.0022%. A preferable upper limit of the N content is 0.0050%, and more preferably is 0.0045%.

O: 0.0100% or Less

Oxygen (O) is an impurity. That is, the O content is more than 0%. O forms coarse oxides and reduces the corrosion resistance of the steel material. Therefore, the O content is 0.0100% or less. A preferable upper limit of the O content is 0.0050%, more preferably is 0.0030%, and further preferably is 0.0020%. Preferably, the O content is as low as possible. However, if the O content is excessively reduced, the production cost increases significantly. Therefore, when taking industrial production into consideration, a preferable lower limit of the O content is 0.0001%, and more preferably is 0.0003%.

The balance of the chemical composition of the steel material according to the present embodiment is Fe and impurities. Here, the term "impurities" refers to elements which, during industrial production of the steel material, are mixed in from ore or scrap that is used as a raw material of the steel material, or from the production environment or the like, and which are allowed within a range that does not adversely affect the steel material according to the present embodiment.

[Regarding Optional Elements]

The chemical composition of the steel material described above may further contain one or more types of element selected from the group consisting of V and Nb in lieu of a part of Fe. Each of these elements is an optional element, and increases the SSC resistance and yield strength of the steel material.

V: 0 to 0.60%

Vanadium (V) is an optional element, and need not be contained. That is, the V content may be 0%. If contained, V combines with C and/or N to form carbides, nitrides or carbo-nitrides (hereinafter, referred to as "carbo-nitrides and the like"). Carbo-nitrides and the like refine the substructure of the steel material by the pinning effect, and increase the SSC resistance of the steel material. V also forms fine carbides during tempering. The fine carbides increase the temper softening resistance of the steel material and increase the yield strength of the steel material. If even a small amount of V is contained, these effects are obtained to a certain extent. However, if the V content is too high, the toughness of the steel material decreases. Therefore, the V content is within the range of 0 to 0.60%. A preferable lower limit of the V content is more than 0%, more preferably is 0.01%, further preferably is 0.02%, further preferably is 0.04%, further preferably is 0.06%, and further preferably is 0.08%. A preferable upper limit of the V content is 0.40%, more preferably is 0.30%, and further preferably is 0.20%.

Nb: 0 to 0.030%

Niobium (Nb) is an optional element, and need not be contained. That is, the Nb content may be 0%. If contained, Nb forms carbo-nitrides and the like. Carbo-nitrides and the like refine the substructure of the steel material by the pinning effect, and increase the SSC resistance of the steel material. Nb also combines with C to form fine carbides. As a result, the yield strength of the steel material increases. If even a small amount of Nb is contained, these effects are obtained to a certain extent. However, if the Nb content is too high, carbo-nitrides and the like are excessively formed and the SSC resistance of the steel material decreases. Therefore, the Nb content is within the range of 0 to 0.030%. A preferable lower limit of the Nb content is more than 0%, more preferably is 0.002%, further preferably is 0.003%, and further preferably is 0.007%. A preferable upper limit of the Nb content is 0.025%, and more preferably is 0.020%.

The chemical composition of the steel material described above may further contain one or more types of element selected from the group consisting of Ca, Mg and Zr in lieu of a part of Fe. Each of these elements is an optional element, and increases the SSC resistance of the steel material.

Ca: 0 to 0.0100%

Calcium (Ca) is an optional element, and need not be contained. That is, the Ca content may be 0%. If contained, Ca renders S in the steel material harmless by forming sulfides, and increases the SSC resistance of the steel material. If even a small amount of Ca is contained, this effect is obtained to a certain extent. However, if the Ca content is too high, oxides in the steel material coarsen and the SSC resistance of the steel material decreases. Therefore, the Ca content is within the range of 0 to 0.0100%. A preferable lower limit of the Ca content is more than 0%, more preferably is 0.0001%, further preferably is 0.0003%, further preferably is 0.0006%, and further preferably is 0.0010%. A preferable upper limit of the Ca content is 0.0040%, more preferably is 0.0030%, and further preferably is 0.0025%.

Mg: 0 to 0.0100%

Magnesium (Mg) is an optional element, and need not be contained. That is, the Mg content may be 0%. If contained, Mg renders S in the steel material harmless by forming sulfides, and increases the SSC resistance of the steel material. If even a small amount of Mg is contained, this effect is obtained to a certain extent. However, if the Mg content is too high, oxides in the steel material coarsen and decrease the SSC resistance of the steel material. Therefore, the Mg content is within the range of 0 to 0.0100%. A preferable lower limit of the Mg content is more than 0%, more preferably is 0.0001%, further preferably is 0.0003%, further preferably is 0.0006%, and further preferably is 0.0010%. A preferable upper limit of the Mg content is 0.0040%, more preferably is 0.0030%, and further preferably is 0.0025%.

Zr: 0 to 0.0100%

Zirconium (Zr) is an optional element, and need not be contained. That is, the Zr content may be 0%. If contained, Zr renders S in the steel material harmless by forming sulfides, and increases the SSC resistance of the steel material. If even a small amount of Zr is contained, this effect is obtained to a certain extent. However, if the Zr content is too high, oxides in the steel material coarsen and the SSC resistance of the steel material decreases. Therefore, the Zr content is within the range of 0 to 0.0100%. A preferable lower limit of the Zr content is more than 0%, more preferably is 0.0001%, further preferably is 0.0003%, further preferably is 0.0006%, and further preferably is 0.0010%. A preferable upper limit of the Zr content is 0.0040%, more preferably is 0.0030%, and further preferably is 0.0025%.

In a case where two or more types of element selected from the aforementioned group consisting of Ca, Mg and Zr are contained in combination, the total amount of the content of these elements is preferably 0.0100% or less, and more preferably is 0.0050% or less.

The chemical composition of the steel material described above may further contain one or more types of element selected from the group consisting of Co and W in lieu of a part of Fe. Each of these elements is an optional element that forms a protective corrosion coating in a sour environment and suppresses hydrogen penetration. By this means, each of these elements increases the SSC resistance of the steel material.

Co: 0 to 0.50%

Cobalt (Co) is an optional element, and need not be contained. That is, the Co content may be 0%. If contained, Co forms a protective corrosion coating in a sour environment and suppresses hydrogen penetration. As a result, the SSC resistance of the steel material increases. If even a small amount of Co is contained, this effect is obtained to a certain extent. However, if the Co content is too high, the hardenability of the steel material will decrease, and the yield strength of the steel material will decrease. Therefore, the Co content is within the range of 0 to 0.50%. A preferable lower limit of the Co content is more than 0%, more preferably is 0.02%, further preferably is 0.03%, and further preferably is 0.05%. A preferable upper limit of the Co content is 0.45%, and more preferably is 0.40%.

W: 0 to 0.50%

Tungsten (W) is an optional element, and need not be contained. That is, the W content may be 0%. If contained, W forms a protective corrosion coating in a sour environment and suppresses hydrogen penetration. As a result, the SSC resistance of the steel material increases. If even a small amount of W is contained, this effect is obtained to a certain extent. However, if the W content is too high, coarse carbides form in the steel material and the SSC resistance of the steel material decreases. Therefore, the W content is within the range of 0 to 0.50%. A preferable lower limit of the W content is more than 0%, more preferably is 0.02%, further preferably is 0.03%, and further preferably is 0.05%. A preferable upper limit of the W content is 0.45%, and more preferably is 0.40%.

The chemical composition of the steel material described above may further contain one or more types of element selected from the group consisting of Ni and Cu in lieu of a part of Fe. Each of these elements is an optional element, and increases the hardenability of the steel.

Ni: 0 to 0.50%

Nickel (Ni) is an optional element, and need not be contained. That is, the Ni content may be 0%. If contained, Ni enhances the hardenability of the steel material and increases the yield strength of the steel material. If even a small amount of Ni is contained, this effect is obtained to a certain extent. However, if the Ni content is too high, the Ni will promote local corrosion, and the SSC resistance of the steel material will decrease. Therefore, the Ni content is within the range of 0 to 0.50%. A preferable lower limit of the Ni content is more than 0%, more preferably is 0.01%, and further preferably is 0.02%. A preferable upper limit of the Ni content is 0.10%, more preferably is 0.08%, and further preferably is 0.06%.

Cu: 0 to 0.50%

Copper (Cu) is an optional element, and need not be contained. That is, the Cu content may be 0%. If contained, Cu enhances the hardenability of the steel material and increases the yield strength of the steel material. If even a small amount of Cu is contained, this effect is obtained to a certain extent. However, if the Cu content is too high, the hardenability of the steel material will be too high, and the SSC resistance of the steel material will decrease. Therefore, the Cu content is within the range of 0 to 0.50%. A preferable lower limit of the Cu content is more than 0%, more preferably is 0.01%, further preferably is 0.02%, and further preferably is 0.05%. A preferable upper limit of the Cu content is 0.35%, and more preferably is 0.25%.

The chemical composition of the aforementioned steel material may also contain a rare earth metal in lieu of a part of Fe.

Rare Earth Metal (REM): 0 to 0.0100%

Rare earth metal (REM) is an optional element, and need not be contained. That is, the REM content may be 0%. If contained, the REM renders S in the steel material harmless by forming sulfides, and increases the SSC resistance of the steel material. REM also combines with P in the steel material and suppresses segregation of P at the crystal grain boundaries. Therefore, a decrease in the SSC resistance of the steel material that is attributable to segregation of P is suppressed. If even a small amount of REM is contained, these effects are obtained to a certain extent. However, if the REM content is too high, oxides coarsen and the low-temperature toughness and SSC resistance of the steel material decrease. Therefore, the REM content is within the range of 0 to 0.0100%. A preferable lower limit of the REM content is more than 0%, more preferably is 0.0001%, further preferably is 0.0003%, and further preferably is 0.0006%. A preferable upper limit of the REM content is 0.0040%, and more preferably is 0.0025%.

Note that, in the present description the term "REM" refers to one or more types of element selected from a group consisting of scandium (Sc) which is the element with atomic number 21, yttrium (Y) which is the element with atomic number 39, and the elements from lanthanum (La) with atomic number 57 to lutetium (Lu) with atomic number 71 that are lanthanoids. Further, in the present description the term "REM content" refers to the total content of these elements.

[Regarding Formula (1)]

The steel material according to the present embodiment also satisfies Formula (1).

$$5\times Cr—Mo-2\times(V+Ti)\leq 3.00 \quad (1)$$

where, a content (mass %) of a corresponding element is substituted for each symbol of an element in Formula (1). If a corresponding element is not contained, "0" is substituted for the symbol of the relevant element.

Fn1 (=5×Cr—Mo-2×(V+Ti)) is an index that indicates the number density of coarse precipitates in a steel material having the aforementioned chemical composition and having reduced the dislocation density in accordance with the yield strength (95 to 125 ksi grade) that it is intended to obtain. In a steel material having the aforementioned chemical composition, if Fn1 is more than 3.00, a large number of coarse precipitates will precipitate in the steel material and the SSC resistance of the steel material will decrease. Therefore, the steel material according to the present embodiment has the aforementioned chemical composition and has reduced the dislocation density in accordance with the yield strength (95 to 125 ksi grade) that it is intended to obtain, furthermore, Fn1 for the steel material is 3.00 or less. In this case, the steel material exhibits excellent SSC resistance in a low-temperature sour environment also. A preferable upper limit of Fn1 is 2.90, and more preferably is 2.87. Although a lower limit of Fn1 is not particularly limited, within the ranges of the aforementioned chemical composition, Fn1 is, in practice, −2.05 or more.

[Regarding Coarse Precipitates]

In the steel material according to the present embodiment, the number density of precipitates having an equivalent circular diameter of 400 nm or more contained is 0.150 particles/$\mu m^2$ or less. As mentioned above, precipitates having an equivalent circular diameter of 400 nm or more are also referred to as "coarse precipitates". Note that, as described above, in the present description, the term "equivalent circular diameter" means the diameter of a circle in a case where the area of a precipitate observed on a visual field surface during micro-structure observation is converted into a circle having the same area.

As described above, in the steel material according to the present embodiment, the dislocation density is reduced in accordance with the yield strength (95 to 125 ksi grade) that it is intended to obtain, a large number of coarse precipitates may precipitate in the steel material in some cases. In such a case, particularly in a low-temperature sour environment, excellent SSC resistance is not obtained. Therefore, in the steel material according to the present embodiment, in addition to having the aforementioned chemical composition and having the aforementioned dislocation density, the number density of coarse precipitates is reduced and the SSC resistance is increased.

Accordingly, in the steel material according to the present embodiment, the number density of coarse precipitates contained in the steel material is 0.150 particles/$\mu m^2$ or less. If the number density of coarse precipitates contained in the steel material is 0.150 particles/$\mu m^2$ or less, on the condition that the other requirements of the present embodiment are satisfied, the steel material exhibits excellent SSC resistance in a low-temperature sour environment also. A preferable upper limit of the number density of coarse precipitates is 0.145 particles/$\mu m^2$, and more preferably is 0.140 particles/$\mu m^2$. Note that, the lower limit of the number density of coarse precipitates is not particularly limited. That is, the number density of coarse precipitates may be 0 particles/$\mu m^2$.

The number density of coarse precipitates in the steel material according to the present embodiment can be determined by the following method. A micro test specimen for creating an extraction replica is taken from the steel material according to the present embodiment. If the steel material is a steel plate, the micro test specimen is taken from a center portion of the thickness. If the steel material is a steel pipe, the micro test specimen is taken from a center portion of the wall thickness. The surface of the micro test specimen is mirror-polished, and thereafter the micro test specimen is immersed for 10 minutes in a 3% nital etching reagent to etch the surface. The etched surface is then covered with a carbon deposited film. The micro test specimen whose surface is covered with the deposited film is immersed for 20 minutes in a 5% nital etching reagent. The deposited film is peeled off from the immersed micro test specimen. The deposited film that was peeled off from the micro test specimen is cleaned with ethanol, and thereafter is scooped up with a sheet mesh and dried.

The deposited film (replica film) is observed using a transmission electron microscope (TEM). Specifically, an arbitrary three locations are specified. Observation of the specified three locations is conducted using an observation magnification of ×10000 and an acceleration voltage of 200 kV, and photographic images of the three locations are generated. Note that, each visual field is, for example, 8 μm×8 μm. Image processing of the photographic images of each visual field is performed, and precipitates in each visual field are identified. The precipitates can be identified based on contrast. The equivalent circular diameter of each precipitate that is identified is determined by image processing.

Precipitates having an equivalent circular diameter of 400 nm or more (coarse precipitates) are identified based on the obtained equivalent circular diameters. The total number of coarse precipitates that were identified in the three visual fields is determined. The number density of coarse precipitates (particles/$\mu m^2$) can be determined based on the thus-determined total number of coarse precipitates and the gross area of the three visual fields. Note that, in the present embodiment, although an upper limit of the equivalent circular diameter of coarse precipitates is not particularly limited, a detection limit value is determined based on the observation visual field. For example, in a case where the observation visual field is 8 μm×8 μm, the detection limit value for the equivalent circular diameter of coarse precipitates is 8000 nm. In this case, the equivalent circular diameter of coarse precipitates is, in practice, within the range of 400 to 8000 nm.

[Yield Strength of Steel Material]

The yield strength of the steel material according to the present embodiment is in the range of 655 to 965 MPa (95 to 125 ksi grade). As used in the present description, the term "yield strength" means 0.2% offset proof stress obtained in a tensile test. In short, the yield strength of the steel material according to the present embodiment is within a range of 95 to 125 ksi grade. Even though the steel material according to the present embodiment has a yield strength within a range of 95 to 125 ksi grade, by satisfying the conditions regarding the chemical composition, the dislocation density, and the number density of coarse precipitates which are described above, the steel material has excellent SSC resistance in a normal-temperature sour environment and a low-temperature sour environment.

The yield strength of the steel material according to the present embodiment can be determined by the following method. A tensile test is performed in accordance with ASTM E8/E8M (2013). A round bar test specimen is taken from the steel material according to the present embodiment. If the steel material is a steel plate, the round bar test specimen is taken from the center portion of the thickness. If the steel material is a steel pipe, the round bar test specimen is taken from the center portion of the wall thickness. Regarding the size of the round bar test specimen, for example, the round bar test specimen has a parallel portion diameter of 4 mm and a parallel portion length of 35 mm. Note that the axial direction of the round bar test specimen is parallel to the rolling direction of the steel material. A tensile test is performed in the atmosphere at normal temperature (25° C.) using the round bar test specimen, and obtained 0.2% offset proof stress is defined as the yield strength (MPa).

[Dislocation Density]

In the steel material according to the present embodiment, the dislocation density is $7.0\times10^{14}$ ($m^{-2}$) or less. As described above, there is a possibility that dislocations will occlude hydrogen. Therefore, if the dislocation density is too high, the concentration of hydrogen occluded in the steel material will increase, and the SSC resistance of the steel material will decrease. On the other hand, dislocations increase the yield strength of the steel material. Therefore, the dislocation density of the steel material according to the present embodiment is reduced in accordance with the yield strength that it is intended to obtain.

[Dislocation Density when Yield Strength is 95 Ksi Grade]

Specifically, in a case where the yield strength of the steel material according to the present embodiment is of 95 ksi grade (655 to less than 758 MPa), the dislocation density is $1.4\times10^{14}$ ($m^{-2}$) or less. As described above, if the dislocation density is too high, the SSC resistance of the steel material will decrease. Therefore, in a case where the yield strength is of 95 ksi grade, the dislocation density of the steel material according to the present embodiment is $1.4\times10^{14}$ ($m^{-2}$) or less. In a case where the yield strength is of 95 ksi grade, a preferable upper limit of the dislocation density of the steel material is less than $1.4\times10^{14}$ ($m^{-2}$), more preferably is $1.3\times10^{14}$ ($m^{-2}$), and further preferably is $1.2\times10^{14}$ ($m^{-2}$). Although the lower limit of the dislocation density of the steel material is not particularly limited, in some cases a yield strength of 95 ksi grade cannot be obtained if the dislocation density is reduced excessively. Therefore, in a case where the yield strength is of 95 ksi grade, a lower limit of the dislocation density of the steel material is, for example, more than $0.1\times10^{14}$ ($m^{-2}$).

[Dislocation Density when Yield Strength is 110 Ksi Grade]

When the steel material according to the present embodiment has a yield strength of 110 ksi grade (758 to less than 862 MPa), the dislocation density is within a range of more than $1.4\times10^{14}$ to less than $3.0\times10^{14}$ ($m^{-2}$). As described above, if the dislocation density is too high, the SSC resistance of the steel material will decrease. On the other hand, if the dislocation density is too low, a yield strength of 110 ksi grade cannot be obtained. Therefore, in a case where the yield strength is of 110 ksi grade, the dislocation density of the steel material according to the present embodiment is within a range of more than $1.4\times10^{14}$ to less than $3.0\times10^{14}$ ($m^{-2}$). In a case where the yield strength is of 110 ksi grade, a preferable upper limit of the dislocation density of the steel material is $2.9\times10^{14}$ ($m^{-2}$), and more preferably is $2.8\times10^{14}$ ($m^{-2}$). In order to stably obtain a yield strength of 110 ksi grade, a preferable lower limit of the dislocation density of the steel material is $1.5\times10^{14}$ ($m^{-2}$).

[Dislocation Density when Yield Strength is 125 Ksi Grade]

When the steel material according to the present embodiment has a yield strength of 125 ksi grade (862 to 965 MPa), the dislocation density is within a range of $3.0\times10^{14}$ to $7.0\times10^{14}$ ($m^{-2}$). As described above, if the dislocation density is too high, the SSC resistance of the steel material will decrease. On the other hand, if the dislocation density is too low, a yield strength of 125 ksi grade cannot be obtained. Therefore, in a case where the yield strength is of 125 ksi grade, the dislocation density of the steel material according to the present embodiment is within a range of $3.0\times10^{14}$ to $7.0\times10^{14}$ ($m^{-2}$). In a case where the yield strength is of 125 ksi grade, a preferable upper limit of the dislocation density of the steel material is $6.5\times10^{14}$ ($m^{-2}$), and more preferably is $6.3\times10^{4}$ ($m^{-2}$). In order to stably obtain a yield strength of 125 ksi grade, a preferable lower limit of the dislocation density of the steel material is $3.1\times10^{14}$ ($m^{-2}$).

The dislocation density of the steel material according to the present embodiment can be determined by the following method. A test specimen for use for dislocation density measurement is taken from the steel material according to the present embodiment. In a case where the steel material is a steel plate, the test specimen is taken from a center portion of the thickness. In a case where the steel material is a steel pipe, the test specimen is taken from a center portion of the wall thickness. The size of the test specimen is, for example, 20 mm width×20 mm length×2 mm thickness. The thickness direction of the test specimen is the thickness direction of the steel material (plate thickness direction or wall thickness direction). In this case, the observation surface of the test specimen is a surface having a size of 20 mm in width×20 mm in length. The observation surface of the test specimen is mirror-polished, and furthermore electropolishing is performed using a 10 vol % perchloric acid (acetic acid solvent) solution to remove strain in the outer layer. The observation surface after the treatment is subjected to X-ray diffraction (XRD) to determine the half-value width AK of the peaks of the (110), (211) and (220) planes of the body-centered cubic structure (iron).

In the XRD, measurement of the half-value width AK is performed by employing CoKα line as the X-ray source, 30 kV as the tube voltage, and 100 mA as the tube current. In addition, $LaB_6$ (lanthanum hexaboride) powder is used in order to measure a half-value width originating from the X-ray diffractometer.

The non-uniform strain E of the test specimen is determined based on the half-value width AK determined by the aforementioned method and the Williamson-Hall equation (Formula (2)).

$$\Delta K\times\cos\theta/\lambda=0.9/D+2\varepsilon\times\sin\theta/\lambda \quad (2)$$

In Formula (2), 0 represents the diffraction angle, λ represents the wavelength of the X-ray, and D represents the crystallite diameter.

In addition, the dislocation density ρ ($m^{-2}$) can be determined using the obtained non-uniform strain E and Formula (3).

$$\rho=14.4\times\varepsilon^2/b^2 \quad (3)$$

In Formula (3), b represents the Burgers vector (b=0.248 (nm)) of the body-centered cubic structure (iron).

[Microstructure]

The microstructure of the steel material according to the present embodiment is principally composed of tempered martensite and tempered bainite. Specifically, the total of the volume ratios of tempered martensite and tempered bainite in the microstructure is 90% or more. The balance of the microstructure is, for example, ferrite or pearlite. If the microstructure of the steel material having the aforementioned chemical composition contains tempered martensite and tempered bainite in an amount equivalent to a total volume ratio of 90% or more, on the condition that the other requirements according to the present embodiment are satisfied, the yield strength of the steel material will be in the range of 655 to 965 MPa (95 to 125 ksi grade).

The total volume ratios of tempered martensite and tempered bainite can be determined by microstructure observation. In a case where the steel material is a steel plate, a test specimen having an observation surface with dimensions of 10 mm in the rolling direction and 10 mm in the thickness direction is cut out from a center portion of the thickness. In addition, in a case where the steel material is a steel plate having a thickness of less than 10 mm, a test specimen having an observation surface with dimensions of 10 mm in the rolling direction and the thickness of the steel plate in the thickness direction is cut out. In a case where the steel material is a steel pipe, a test specimen having an observation surface with dimensions of 10 mm in the pipe axis direction and 10 mm in the pipe radial direction is cut out from a center portion of the wall thickness. In addition, in a case where the steel material is a steel pipe having a wall thickness of less than 10 mm, a test specimen having an observation surface with dimensions of 10 mm in the pipe axis direction and a wall thickness of the steel pipe in the pipe radial direction is cut out. After polishing the observation surface to obtain a mirror surface, the test specimen is immersed for about 10 seconds in a 2% nital etching reagent, to reveal the microstructure by etching. The etched observation surface is observed by performing observation with respect to 10 visual fields by means of a secondary electron image obtained using a scanning electron microscope (SEM). The visual field area is 400 $\mu m^2$ (magnification of ×5000). In each visual field, tempered martensite and tempered bainite can be distinguished from other phases (for example, ferrite or pearlite) based on contrast. Accordingly, tempered martensite and tempered bainite are identified in each visual field. The totals of the area fractions of the identified tempered martensite and tempered bainite are determined. In the present embodiment, the arithmetic average value of the totals of the area fractions of tempered martensite and tempered bainite determined in all of the visual fields is defined as the volume ratio of tempered martensite and tempered bainite.

[Shape of Steel Material]

The shape of the steel material according to the present embodiment is not particularly limited. The steel material is, for example, a steel pipe or a steel plate. The steel material may also be a solid material (steel bar). In a case where the steel material is an oil-well steel pipe, a preferable wall thickness is 9 to 60 mm. More preferably, the steel material according to the present embodiment is suitable for use as a heavy-wall seamless steel pipe. In a case where the steel material according to the present invention is a seamless steel pipe, even if the seamless steel pipe has a thick wall with a thickness of 15 mm or more, the seamless steel pipe has a yield strength within a range of 655 to 965 MPa (95 to 125 ksi grade) and exhibits excellent SSC resistance in a normal-temperature sour environment and a low-temperature sour environment.

[SSC Resistance of Steel Material]

As described above, when the dislocation density is high, the concentration of hydrogen occluded in the steel material increases and the SSC resistance of the steel material decreases. On the other hand, dislocations increase the yield strength. Therefore, in the steel material according to the present embodiment, the dislocation density is reduced according to the yield strengths (95 to 125 ksi grade) that it is intended to obtain. That is, the lower the yield strength of the steel material is, the more the dislocation density is reduced, and therefore the more excellent the SSC resistance that is obtained. Therefore, according to the steel material of the present embodiment, excellent SSC resistance is defined for each yield strength (95 to 125 ksi grade) that it is intended to obtain.

Note that, the SSC resistance of the steel material according to the present embodiment can be evaluated by means of a normal-temperature SSC resistance test and a low-temperature SSC resistance test, for either the yield strength. The normal-temperature SSC resistance test and the low-temperature SSC resistance test are each performed by a method in accordance with "Method A" specified in NACE TM0177-2005.

[SSC Resistance when Yield Strength is 95 Ksi Grade]

In a case where the yield strength of the steel material is of 95 ksi grade, the SSC resistance of the steel material can be evaluated by the following method. In the normal-temperature SSC resistance test, a mixed aqueous solution containing 5.0 mass % of sodium chloride and 0.5 mass % of acetic acid (NACE solution A) is employed as a test solution. A round bar test specimen is taken from the steel material according to the present embodiment. In a case where the steel material is a steel plate, the round bar test specimen is taken from the center portion of the thickness. In a case where the steel material is a steel pipe, the round bar test specimen is taken from the center portion of the wall thickness. Regarding the size of the round bar test specimen, for example, the round bar test specimen has a diameter of 6.35 mm and a parallel portion length of 25.4 mm. Note that the axial direction of the round bar test specimen is parallel to the rolling direction of the steel material. A stress equivalent to 95% of the actual yield stress is applied to the round bar test specimen. The test solution at 24° C. is poured into a test vessel so that the round bar test specimen to which the stress has been applied is immersed therein, and this is adopted as a test bath. After degassing the test bath, $H_2S$ gas at 1 atm pressure is blown into the test bath and is caused to saturate in the test bath. The test bath into which the $H_2S$ gas at 1 atm pressure was blown is held for 720 hours at 24° C.

On the other hand, in the low-temperature SSC resistance test, a mixed aqueous solution containing 5.0 mass % of sodium chloride and 0.5 mass % of acetic acid (NACE solution A) is employed as a test solution. A round bar test specimen is taken from the steel material according to the present embodiment. If the steel material is a steel plate, the round bar test specimen is taken from the center portion of the thickness. If the steel material is a steel pipe, the round bar test specimen is taken from the center portion of the wall thickness. Regarding the size of the round bar test specimen, for example, the round bar test specimen has a diameter of 6.35 mm and a parallel portion length of 25.4 mm. Note that the axial direction of the round bar test specimen is parallel to the rolling direction of the steel material. A stress equivalent to 95% of the actual yield stress is applied to the round bar test specimen. The test solution at 4° C. is poured into a test vessel so that the round bar test specimen to which the stress has been applied is immersed therein, and this is adopted as a test bath. After degassing the test bath, $H_2S$ gas at 1 atm pressure is blown into the test bath and is caused to saturate in the test bath. The test bath into which the $H_2S$ gas at 1 atm pressure was blown is held for 720 hours at 4° C.

In a case where the yield strength of the steel material is of 95 ksi grade, the steel material according to the present embodiment, cracking is not confirmed after 720 hours elapses in both the normal-temperature SSC resistance test and the low-temperature SSC resistance test. Note that, in the present description, the term "cracking is not confirmed" means that cracking is not confirmed in a test specimen in a case where the test specimen after the test was observed by the naked eye and by means of a projector with a magnification of ×10.

[SSC Resistance when Yield Strength is 110 Ksi Grade]

In a case where the yield strength of the steel material is of 110 ksi grade, the SSC resistance of the steel material can be evaluated by the following method. The normal-temperature SSC resistance test is performed in a similar manner to the aforementioned normal-temperature SSC resistance test when the yield strength is of 95 ksi grade except that the stress that is applied to the round bar specimen is equivalent to 90% of the actual yield stress.

On the other hand, the low-temperature SSC resistance test is performed in a similar manner to the aforementioned normal-temperature SSC resistance test when the yield strength is of 95 ksi grade except that the stress that is applied to the round bar specimen is equivalent to 85% of the actual yield stress. In a case where the yield strength of the steel material is of 110 ksi grade, the steel material according to the present embodiment, cracking is not confirmed after 720 hours elapses in both the normal-temperature SSC resistance test and the low-temperature SSC resistance test.

[SSC Resistance when Yield Strength is 125 Ksi Grade]

In a case where the yield strength of the steel material is of 125 ksi grade, the SSC resistance of the steel material can be evaluated by the following method. The normal-temperature SSC resistance test is performed in a similar manner to the aforementioned normal-temperature SSC resistance test when the yield strength is of 95 ksi grade except that the stress that is applied to the round bar specimen is equivalent to 90% of the actual yield stress.

On the other hand, the low-temperature SSC resistance test is performed in a similar manner to the aforementioned normal-temperature SSC resistance test when the yield strength is of 95 ksi grade except that the stress that is applied to the round bar specimen is equivalent to 80% of the actual yield stress. In a case where the yield strength of the steel material is of 125 ksi grade, the steel material according to the present embodiment, cracking is not confirmed after 720 hours elapses in both the normal-temperature SSC resistance test and the low-temperature SSC resistance test.

[Production Method]

A method for producing the steel material according to the present embodiment will now be described. The production method described hereunder is a method for producing a steel pipe as one example of the steel material according to the present embodiment. Note that, a method for producing the steel material according to the present embodiment is not limited to the production method described hereunder.

[Preparation Process]

In the preparation process, an intermediate steel material having the aforementioned chemical composition is prepared. The method for producing the intermediate steel material is not particularly limited as long as the intermediate steel material has the aforementioned chemical composition. As used here, the term "intermediate steel material" refers to a plate-shaped steel material in a case where the end product is a steel plate, and refers to a hollow shell in a case where the end product is a steel pipe.

The preparation process may preferably include a process in which a starting material is prepared (starting material preparation process), and a process in which the starting material is subjected to hot working to produce an intermediate steel material (hot working process). Hereunder, a case in which the preparation process includes the starting material preparation process and the hot working process is described in detail.

[Starting Material Preparation Process]

In the starting material preparation process, a starting material is produced using molten steel having the aforementioned chemical composition. The method for producing the starting material is not particularly limited, and a well-known method can be used. Specifically, a cast piece (a slab, bloom or billet) is produced by a continuous casting process using the molten steel. An ingot may also be produced by an ingot-making process using the molten steel. As necessary, the slab, bloom or ingot may be subjected to blooming to produce a billet. The starting material (a slab, bloom or billet) is produced by the above described process.

[Hot Working Process]

In the hot working process, the starting material that was prepared is subjected to hot working to produce an intermediate steel material. In a case where the steel material is a steel pipe, the intermediate steel material corresponds to a hollow shell. First, the billet is heated in a heating furnace. Although the heating temperature is not particularly limited, for example, the heating temperature is within a range of 1100 to 1300° C. The billet that is extracted from the heating furnace is subjected to hot working to produce a hollow shell (seamless steel pipe). The method of performing the hot working is not particularly limited, and a well-known method can be used. For example, the Mannesmann process is performed as the hot working to produce the hollow shell. In this case, a round billet is piercing-rolled using a piercing machine. When performing piercing-rolling, although the piercing ratio is not particularly limited, the piercing ratio is, for example, within a range of 1.0 to 4.0. The round billet that underwent piercing-rolling is further hot-rolled to form a hollow shell using a mandrel mill, a reducer, a sizing mill or the like. The cumulative reduction of area in the hot working process is, for example, 20 to 70%.

A hollow shell may also be produced from the billet by another hot working method. For example, in the case of a heavy-wall steel material of a short length such as a coupling, a hollow shell may be produced by forging by the Ehrhardt process or the like. A hollow shell is produced by the above process. Although not particularly limited, the wall thickness of the hollow shell is, for example, 9 to 60 mm.

The hollow shell produced by hot working may be air-cooled (as-rolled). The hollow shell produced by hot working may be subjected to direct quenching after hot working without being cooled to normal temperature, or may be subjected to quenching after undergoing supplementary heating (reheating) after hot working. However, in the case of performing direct quenching or quenching after supplementary heating, it is preferable to stop the cooling midway through the quenching process and conduct slow cooling for the purpose of suppressing quench cracking.

In a case where direct quenching is performed after hot working, or quenching is performed after supplementary heating after hot working, for the purpose of eliminating residual stress it is preferable to perform a stress relief treatment (SR treatment) at a time that is after quenching and before the heat treatment (quenching and the like) of the next process.

As described above, an intermediate steel material is prepared in the preparation process. The intermediate steel material may be produced by the aforementioned preferable process, or may be an intermediate steel material that was produced by a third party, or an intermediate steel material that was produced in another factory other than the factory in which a quenching process and a tempering process that are described later are performed, or at a different works. The quenching process is described in detail hereunder.

[Quenching Process]

In the quenching process, the intermediate steel material (hollow shell) that was prepared is subjected to quenching. In the present description, the term "quenching" means rapidly cooling the intermediate steel material that is at a temperature not less than the $A_3$ point. A preferable quenching temperature is 800 to 1000° C. In a case where direct quenching is performed after hot working, the quenching temperature corresponds to the surface temperature of the intermediate steel material that is measured by a thermometer placed on the exit side of the apparatus that performs the final hot working. Further, in a case where quenching is performed using a supplementary heating furnace or a beat treatment furnace after hot working, the quenching temperature corresponds to the temperature of the supplementary heating furnace or the heat treatment furnace.

If the quenching temperature is too high, in some cases prior-austenite grains become coarse and the SSC resistance of the steel material decreases. Therefore, a quenching temperature in the range of 800 to 1000° C. is preferable. A more preferable upper limit of the quenching temperature is 950° C.

The quenching method, for example, continuously cools the intermediate steel material from the quenching starting temperature, and continuously decreases the temperature of the intermediate steel material. The method of performing the continuous cooling treatment is not particularly limited, and a well-known method can be used. The method of performing the continuous cooling treatment is, for example, a method that cools the intermediate steel material by immersing the intermediate steel material in a water bath, or a method that cools the intermediate steel material in an accelerated manner by shower water cooling or mist cooling.

If the cooling rate during quenching is too slow, the microstructure does not become one that is principally composed of martensite and bainite, and the mechanical properties defined in the present embodiment (that is, a yield strength within a range of 95 to 125 ksi grade) cannot be obtained. Therefore, in the method for producing the steel material according to the present embodiment, the intermediate steel material (hollow shell) is rapidly cooled during quenching. Specifically, in the quenching process, the average cooling rate when the temperature of the intermediate steel material (hollow shell) is within the range of 800 to 500° C. during quenching is defined as a cooling rate during quenching $CR_{800\text{-}500}$ (° C./sec). More specifically, the cooling rate during quenching $CR_{800\text{-}500}$ is determined based on a temperature that is measured at a region that is most slowly cooled within a cross-section of the intermediate steel material that is being quenched (for example, in the case of forcedly cooling both surfaces, the cooling rate is measured at the center portion of the thickness of the intermediate steel material).

A preferable cooling rate during quenching $CR_{800\text{-}500}$ is 8° C./sec or higher. In this case, the microstructure of the intermediate steel material (hollow shell) after quenching stably becomes a microstructure that is principally composed of martensite and bainite. A more preferable lower limit of the cooling rate during quenching $CR_{800\text{-}500}$ is 10° C./sec. A preferable upper limit of the cooling rate during quenching $CR_{800\text{-}500}$ is 500° C./sec.

Preferably, quenching is performed after performing heating of the intermediate steel material in the austenite zone a plurality of times. In this case, the SSC resistance of the steel material further increases because austenite grains are refined prior to quenching. Heating in the austenite zone may be repeated a plurality of times by performing quenching a plurality of times, or heating in the austenite zone may be repeated a plurality of times by performing normalizing and quenching. Hereunder, the tempering process is described below in detail.

[Tempering Process]

The tempering process is carried out by performing tempering after performing the aforementioned quenching. In the present description, the term "tempering" means reheating the intermediate steel material after quenching to a temperature that is not more than the Ai point and holding the intermediate steel material at that temperature. The tempering temperature is appropriately adjusted in accordance with the chemical composition of the steel material and the yield strength, which is to be obtained. That is, with respect to the intermediate steel material (hollow shell) having the chemical composition of the present embodiment, the tempering temperature is adjusted so as to adjust the yield strength of the steel material to within a range of 655 to 965 MPa (95 to 125 ksi grade). Here, the tempering temperature corresponds to the temperature of the furnace when the intermediate steel material after quenching is heated and held at the relevant temperature. Here, the tempering time (holding time) means the period of time from the temperature of the intermediate steel material reaching a predetermined tempering temperature till the extracting from the furnace.

Normally, in the case of producing a steel material that is to be used for oil wells, in order to increase the SSC resistance, the dislocation density is reduced by making the tempering temperature a high temperature that is within the range of 600 to 730° C. However, in this case, alloy carbides finely disperse when the steel material is being held for tempering. Because the finely dispersed alloy carbides act as obstacles to the movement of dislocations, the finely dispersed alloy carbides suppress recovery of the dislocations (that is, the disappearance of the dislocations). Therefore, in the case of performing only tempering at a high temperature that is performed to reduce the dislocation density, the dislocation density cannot be adequately reduced in some cases.

Therefore, the steel material according to the present embodiment is subjected to tempering at a low temperature to thereby reduce the dislocation density to a certain extent in advance. In addition, tempering is performed at a high temperature and the dislocation density is also reduced. That is, in the tempering process according to the present embodiment, tempering is performed in two stages. According to this method, the dislocation density can be reduced while maintaining a yield strength. Therefore, according to two stages tempering, even if the dislocation density is reduced to $1.4\times10^{14}$ ($m^{-2}$) or less, the yield strength can be adjusted to within a range of 655 to less than 758 MPa (95 ksi grade). According to two stages tempering, even if the dislocation density is reduced to within a range of more than $1.4\times10^{14}$ to less than $3.0\times10^{14}$ ($m^{-2}$), the yield strength can be adjusted to within a range of 758 to less than 862 MPa (110 ksi grade). According to two stages tempering, even if the dislocation density is reduced to within a range of $3.0\times10^{14}$ to $7.0\times10^{14}$ ($m^{-2}$), the yield strength can be adjusted to within a range of 862 to 965 MPa (125 ksi grade). Hereunder, the low-temperature tempering process and high-temperature tempering process are described in detail.

[Low-Temperature Tempering Process]

In the low-temperature tempering process, a preferable tempering temperature is within the range of 100 to 500° C. If the tempering temperature in the low-temperature tempering process is too high, alloy carbides will finely disperse while the steel material is being held at the tempering temperature during tempering, and in some cases the dislocation density cannot be adequately reduced. In such a case, the yield strength of the steel material becomes too high and/or the SSC resistance of the steel material decreases. On the other hand, if the tempering temperature during the low-temperature tempering process is too low, in some cases the dislocation density cannot be reduced while the steel material is being held at the tempering temperature during tempering. In such a case, the yield strength of the steel material becomes too high and/or the SSC resistance of the steel material decreases. Therefore, it is preferable to set the tempering temperature in the low-temperature tempering process within the range of 100 to 500° C. A more preferable lower limit of the tempering temperature in the low-temperature tempering process is 150° C. A more preferable upper limit of the tempering temperature in the low-temperature tempering process is 450° C., and further preferably is 420° C.

In the low-temperature tempering process, a preferable holding time for tempering (tempering time) is within the range of 10 to 90 minutes. If the tempering time in the low-temperature tempering process is too short, in some cases the dislocation density cannot be adequately reduced. In such a case, the yield strength of the steel material becomes too high and/or the SSC resistance of the steel material decreases. On the other hand, if the tempering time in the low-temperature tempering process is too long, the aforementioned effects are saturated. Accordingly, in the present embodiment the tempering time is preferably set within the range of 10 to 90 minutes. A more preferable upper limit of the tempering time is 80 minutes. Note that, in a case where the steel material is a steel pipe, in comparison to other shapes, temperature variations with respect to the steel pipe are liable to occur during holding for tempering. Therefore, in a case where the steel material is a steel pipe, the tempering time is preferably set within a range of 15 to 90 minutes.

[High-Temperature Tempering Process]

In the high-temperature tempering process, the conditions for tempering are appropriately controlled in accordance with the yield strength which it is intended to obtain. A preferable tempering temperature in the high-temperature tempering process is within the range of 660 to 740° C. If the tempering temperature during the high-temperature tempering process is too high, in some cases the dislocation density is reduced too much and a yield strength which it is intended to obtain cannot be obtained. In contrast, if the tempering temperature during the high-temperature tempering process is too low, in some cases the dislocation density cannot be adequately reduced. In such a case, the yield strength of the steel material becomes too high and/or the SSC resistance of the steel material decreases. Accordingly, a preferable tempering temperature in the high-temperature tempering process is within the range of 660 to 740° C.

When it is intended to obtain a yield strength of 95 ksi grade, a more preferable lower limit of the tempering temperature in the high-temperature tempering process is 670° C., and further preferably is 680° C. When it is intended to obtain a yield strength of 95 ksi grade, a more preferable upper limit of the tempering temperature in the high-temperature tempering process is 735° C. When it is intended to obtain a yield strength of 110 ksi grade, a more preferable lower limit of the tempering temperature in the high-temperature tempering process is 670° C. When it is intended to obtain a yield strength of 110 ksi grade, a more preferable upper limit of the tempering temperature in the high-temperature tempering process is 730° C., and further preferably is 720° C. When it is intended to obtain a yield strength of 125 ksi grade, a more preferable lower limit of the tempering temperature in the high-temperature tempering process is 670° C. When it is intended to obtain a yield strength of 125 ksi grade, a more preferable upper limit of the tempering temperature in the high-temperature tempering process is 730° C., and further preferably is 720° C.

In the high-temperature tempering process, a preferable tempering time is within the range of 10 to 180 minutes. If the tempering time is too short, in some cases the dislocation density cannot be adequately reduced. In such a case, the yield strength of the steel material becomes too high and/or the SSC resistance of the steel material decreases. On the other hand, if the tempering time is too long, the aforementioned effects are saturated. Therefore, in the present embodiment, a preferable tempering time is within the range of 10 to 180 minutes. A more preferable upper limit of the tempering time is 120 minutes, and further preferably is 90 minutes. Note that in a case where the steel material is a steel pipe, as described above, temperature variations are liable to occur. Therefore, when the steel material is a steel pipe, the tempering time is preferably set within the range of 15 to 180 minutes.

The aforementioned low-temperature tempering process and high-temperature tempering process can be performed as consecutive heat treatments. That is, after performing the aforementioned holding for tempering in the low-temperature tempering process, next, the high-temperature tempering process may be performed in a successive manner by heating the steel material. At this time, the low-temperature tempering process and the high-temperature tempering process may be performed within the same heat treatment furnace.

On the other hand, the aforementioned low-temperature tempering process and high-temperature tempering process can also be performed as non-consecutive heat treatments. That is, after performing the aforementioned holding for tempering in the low-temperature tempering process, the steel material may be temporarily cooled to a lower temperature than the aforementioned tempering temperature, and thereafter heated again to perform the high-temperature tempering process. Even in this case, the effects obtained by the low-temperature tempering process and high-temperature tempering process are not impaired, and the steel material according to the present embodiment can be produced.

The steel material according to the present embodiment can be produced by the production method that is described above. Note that a method for producing a steel pipe has been described as one example of the aforementioned production method. However, the steel material according to the present embodiment may be a steel plate or another shape. A method for producing a steel plate or a steel material of another shape also includes, for example, a preparation process, a quenching process and a tempering process, similarly to the production method described above. In addition, the aforementioned production method is one example, and the steel material according to the present embodiment may also be produced by another production method.

Hereunder, the present invention is described more specifically by way of examples.

Example 1

In Example 1, in a case where the yield strength of the steel material is of 95 ksi grade (655 to less than 758 MPa), the SSC resistance in a normal-temperature sour environment and a low-temperature sour environment was investigated. Specifically, molten steels of a weight of 180 kg having the chemical compositions shown in Table 1 were produced. In addition, Fn1 that was determined based on the obtained chemical composition and Formula (1) is shown in Table 2.

TABLE 1

| Test | Chemical Composition (Unit is mass %; balance is Fe and impurities) | | | | | | | | | | | |
|---|---|---|---|---|---|---|---|---|---|---|---|---|
| Number | C | Si | Mn | P | S | Al | Cr | Mo | Ti | B | N | O |
| 1-1 | 0.29 | 0.33 | 0.22 | 0.007 | 0.0009 | 0.049 | 0.47 | 1.38 | 0.013 | 0.0012 | 0.0038 | 0.0014 |
| 1-2 | 0.25 | 0.24 | 0.05 | 0.006 | 0.0006 | 0.051 | 0.64 | 1.24 | 0.012 | 0.0015 | 0.0028 | 0.0009 |
| 1-3 | 0.26 | 0.27 | 0.38 | 0.011 | 0.0007 | 0.031 | 0.70 | 0.97 | 0.015 | 0.0014 | 0.0039 | 0.0017 |
| 1-4 | 0.24 | 0.24 | 0.15 | 0.006 | 0.0008 | 0.052 | 0.61 | 1.16 | 0.010 | 0.0013 | 0.0027 | 0.0012 |
| 1-5 | 0.30 | 0.23 | 0.20 | 0.007 | 0.0010 | 0.029 | 0.46 | 1.34 | 0.014 | 0.0014 | 0.0030 | 0.0019 |
| 1-6 | 0.28 | 0.35 | 0.46 | 0.009 | 0.0010 | 0.025 | 0.72 | 0.92 | 0.011 | 0.0012 | 0.0042 | 0.0013 |
| 1-7 | 0.29 | 0.23 | 0.34 | 0.007 | 0.0007 | 0.025 | 0.62 | 1.10 | 0.015 | 0.0015 | 0.0025 | 0.0019 |
| 1-8 | 0.28 | 0.31 | 0.20 | 0.007 | 0.0007 | 0.033 | 0.72 | 0.83 | 0.009 | 0.0015 | 0.0026 | 0.0011 |
| 1-9 | 0.30 | 0.28 | 0.16 | 0.009 | 0.0006 | 0.044 | 0.70 | 0.84 | 0.010 | 0.0012 | 0.0023 | 0.0009 |
| 1-10 | 0.29 | 0.23 | 0.24 | 0.012 | 0.0009 | 0.055 | 0.53 | 1.40 | 0.015 | 0.0011 | 0.0033 | 0.0014 |
| 1-11 | 0.25 | 0.31 | 0.35 | 0.009 | 0.0010 | 0.039 | 0.65 | 1.49 | 0.009 | 0.0013 | 0.0040 | 0.0006 |
| 1-12 | 0.24 | 0.25 | 0.30 | 0.010 | 0.0010 | 0.028 | 0.69 | 1.27 | 0.009 | 0.0011 | 0.0030 | 0.0006 |
| 1-13 | 0.28 | 0.31 | 0.39 | 0.006 | 0.0007 | 0.047 | 0.46 | 1.50 | 0.011 | 0.0011 | 0.0025 | 0.0019 |
| 1-14 | 0.25 | 0.35 | 0.33 | 0.007 | 0.0008 | 0.034 | 0.71 | 1.30 | 0.013 | 0.0011 | 0.0034 | 0.0006 |
| 1-15 | 0.24 | 0.26 | 0.46 | 0.008 | 0.0010 | 0.051 | 0.47 | 1.30 | 0.013 | 0.0012 | 0.0039 | 0.0018 |
| 1-16 | 0.29 | 0.22 | 0.41 | 0.007 | 0.0007 | 0.034 | 0.76 | 0.72 | 0.010 | 0.0015 | 0.0029 | 0.0019 |
| 1-17 | 0.24 | 0.26 | 0.25 | 0.011 | 0.0008 | 0.054 | 0.79 | 0.58 | 0.005 | 0.0013 | 0.0028 | 0.0015 |
| 1-18 | 0.29 | 0.23 | 0.44 | 0.009 | 0.0007 | 0.032 | 1.03 | 0.83 | 0.011 | 0.0012 | 0.0024 | 0.0007 |
| 1-19 | 0.24 | 0.33 | 0.45 | 0.006 | 0.0009 | 0.054 | 0.62 | 0.81 | 0.009 | 0.0015 | 0.0041 | 0.0007 |
| 1-20 | 0.28 | 0.34 | 0.45 | 0.006 | 0.0007 | 0.036 | 0.75 | 1.40 | 0.013 | 0.0012 | 0.0026 | 0.0011 |
| 1-21 | 0.28 | 0.34 | 0.45 | 0.010 | 0.0008 | 0.041 | 1.02 | 0.91 | 0.015 | 0.0015 | 0.0025 | 0.0013 |
| 1-22 | 0.26 | 0.25 | 1.64 | 0.012 | 0.0010 | 0.033 | 0.56 | 1.07 | 0.013 | 0.0012 | 0.0047 | 0.0016 |
| 1-23 | 0.25 | 0.27 | 0.34 | 0.006 | 0.0006 | 0.039 | 0.11 | 0.96 | 0.011 | 0.0013 | 0.0036 | 0.0012 |
| 1-24 | 0.30 | 0.34 | 0.28 | 0.009 | 0.0007 | 0.026 | 0.74 | 0.13 | 0.011 | 0.0013 | 0.0044 | 0.0006 |
| 1-25 | 0.59 | 0.35 | 0.29 | 0.007 | 0.0006 | 0.046 | 0.66 | 1.02 | 0.009 | 0.0011 | 0.0045 | 0.0014 |

| Test | Chemical Composition (Unit is mass %; balance is Fe and impurities) | | | | | | | | | |
|---|---|---|---|---|---|---|---|---|---|---|
| Number | V | Nb | Ca | Mg | Zr | Co | W | Ni | Cu | Nd |
| 1-1 | — | — | — | — | — | — | — | — | — | — |
| 1-2 | — | — | — | — | — | — | — | — | — | — |
| 1-3 | — | — | — | — | — | — | — | — | — | — |
| 1-4 | — | — | — | — | — | — | — | — | — | — |
| 1-5 | — | — | — | — | — | — | — | — | — | — |
| 1-6 | 0.13 | — | — | — | — | — | — | — | — | — |
| 1-7 | — | 0.015 | — | — | — | — | — | — | — | — |
| 1-8 | — | — | 0.0012 | — | — | — | — | — | — | — |
| 1-9 | — | — | — | 0.0011 | — | — | — | — | — | — |
| 1-10 | — | — | — | — | 0.0019 | — | — | — | — | — |
| 1-11 | — | — | — | — | — | 0.30 | — | — | — | — |
| 1-12 | — | — | — | — | — | — | 0.39 | — | — | — |
| 1-13 | — | — | — | — | — | — | — | 0.02 | — | — |
| 1-14 | — | — | — | — | — | — | — | — | 0.06 | — |
| 1-15 | — | — | — | — | — | — | — | — | — | 0.0018 |
| 1-16 | — | — | — | — | — | — | — | — | — | — |
| 1-17 | — | — | — | — | — | — | — | — | — | — |
| 1-18 | 0.09 | — | — | — | — | — | — | — | — | — |
| 1-19 | — | 0.013 | — | — | — | — | — | — | — | — |
| 1-20 | — | — | — | — | — | — | — | — | — | — |
| 1-21 | 0.05 | 0.014 | — | — | — | — | — | — | 0.07 | — |
| 1-22 | — | — | — | — | — | — | — | — | — | — |
| 1-23 | — | — | — | — | — | — | — | — | — | — |
| 1-24 | — | — | — | — | — | — | — | — | — | — |
| 1-25 | — | — | — | — | — | — | — | — | — | — |

TABLE 2

| Test Number | Fn1 | First Tempering: Tempering Temperature (° C.) | First Tempering: Tempering Time (min) | Second Tempering: Tempering Temperature (° C.) | Second Tempering: Tempering Time (min) | YS (MPa) | Dislocation Density ρ ($\times 10^{14} \times m^{-2}$) | Number Density of Coarse Precipitates (particles/$\mu m^2$) | SSC Resistance: 1atm $K_2S$ (24° C.) | SSC Resistance: 1atm $H_2S$ (4° C.) |
|---|---|---|---|---|---|---|---|---|---|---|
| 1-1 | 0.94 | 300 | 20 | 720 | 45 | 712 | 0.8 | 0.047 | E | E |
| 1-2 | 1.94 | 300 | 20 | 720 | 45 | 704 | 0.7 | 0.078 | E | E |
| 1-3 | 2.50 | 300 | 20 | 720 | 45 | 707 | 0.7 | 0.031 | E | E |
| 1-4 | 1.87 | 300 | 20 | 720 | 45 | 702 | 0.6 | 0.063 | E | E |
| 1-5 | 0.93 | 200 | 50 | 720 | 45 | 714 | 0.9 | 0.063 | E | E |
| 1-6 | 2.40 | 400 | 15 | 730 | 45 | 711 | 0.8 | 0.000 | E | E |
| 1-7 | 1.97 | 250 | 20 | 730 | 50 | 708 | 0.8 | 0.031 | E | E |
| 1-8 | 2.75 | 250 | 20 | 730 | 30 | 661 | 0.3 | 0.109 | E | E |
| 1-9 | 2.64 | 200 | 30 | 730 | 30 | 665 | 0.4 | 0.063 | E | E |
| 1-10 | 1.22 | 200 | 30 | 720 | 80 | 697 | 0.5 | 0.016 | E | E |
| 1-11 | 1.74 | 200 | 60 | 730 | 30 | 657 | 0.3 | 0.063 | E | E |
| 1-12 | 2.16 | 200 | 40 | 730 | 60 | 655 | 0.3 | 0.078 | E | E |
| 1-13 | 0.78 | 200 | 40 | 730 | 45 | 662 | 0.3 | 0.031 | E | E |
| 1-14 | 2.22 | 200 | 35 | 720 | 90 | 686 | 0.5 | 0.031 | E | E |
| 1-15 | 1.02 | 200 | 35 | 730 | 30 | 660 | 0.3 | 0.047 | E | E |
| 1-16 | 3.06 | 200 | 35 | 720 | 50 | 713 | 0.9 | 0.188 | E | NA |
| 1-17 | 3.36 | 200 | 35 | 720 | 50 | 709 | 0.8 | 0.250 | E | NA |
| 1-18 | 4.12 | 200 | 35 | 730 | 50 | 714 | 1.0 | 0.328 | E | NA |
| 1-19 | 2.27 | 720 | 40 | 550 | 80 | 726 | 3.2 | 0.031 | E | NA |
| 1-20 | 2.32 | 720 | 60 | — | — | 711 | 3.1 | 0.063 | E | NA |
| 1-21 | 4.06 | 720 | 50 | — | — | 754 | 3.5 | 0.281 | E | NA |
| 1-22 | 1.70 | 200 | 20 | 720 | 45 | 710 | 0.8 | 0.094 | NA | NA |
| 1-23 | −0.43 | 200 | 20 | 720 | 50 | 701 | 0.7 | 0.094 | NA | NA |
| 1-24 | 3.55 | 200 | 20 | 720 | 30 | 702 | 0.7 | 0.297 | NA | NA |
| 1-25 | 2.26 | 200 | 20 | 730 | 70 | 756 | 1.3 | 0.188 | E | NA |

Ingots were produced using the aforementioned molten steels. The ingots were hot rolled to produce steel plates having a thickness of 15 mm.

Steel plates of Test Numbers 1-1 to 1-25 after hot rolling were allowed to cool to bring the steel plate temperature to normal temperature (25° C.). Next, after being allowed to cool, the steel plates of Test Numbers 1-1 to 1-25 were subjected to quenching. Note that, a type K thermocouple of a sheath type was inserted into a center portion of the thickness of the steel plate in advance, and the quenching temperature and cooling rate during quenching were measured using the type K thermocouple.

The steel plates of Test Numbers 1-1 to 1-25 were subjected to quenching once. Specifically, after being allowed to cool as described above, the steel plate was reheated and the steel plate temperature was adjusted so as to become the quenching temperature (920° C.), and the steel plate was held for 20 minutes. Thereafter, water cooling was performed using a shower-type water cooling apparatus. The average cooling rate from 800° C. to 500° C. during quenching of the steel plates of Test Numbers 1-1 to 1-25, that is, the cooling rate during quenching ($CR_{800-500}$) (° C./sec), was 10° C./sec.

After quenching, the steel plates of Test Numbers 1-1 to 1-25 were subjected to a tempering process. For the steel plates of Test Numbers 1-1 to 1-19 and 1-22 to 1-25, a first tempering and a second tempering were performed. On the other hand, for the steel plates of Test Numbers 1-20 and 1-21, a tempering was performed only once. A tempering temperature (° C.) and tempering time (min) for each of the first tempering and the second tempering are shown in Table 2. Note that, the tempering temperature in the present examples was brought to the temperature of the furnace in which tempering was performed. The tempering time in the present examples was taken as the period of time from the temperature of the steel plate of each test number reaching a predetermined tempering temperature till the extracting from the furnace.

[Evaluation Tests]

A tensile test, a dislocation density measurement test, a coarse precipitates number density measurement test, and an SSC resistance evaluation test that are described hereunder were performed on the steel plate of Test Numbers 1-1 to 1-25 after the aforementioned tempering process.

[Tensile Test]

A tensile test was performed in conformity with ASTM E8/E8M (2013). Round bar test specimens having a parallel portion diameter of 4 mm and a parallel portion length of 35 mm were prepared from the center portion of the thickness of the steel plate of Test Numbers 1-1 to 1-25. The axial direction of the round bar test specimens was parallel to the rolling direction of the steel plate. A tensile test was performed in the atmosphere at normal temperature (25° C.) using each round bar test specimen, and the yield strength (MPa) of the steel plate of Test Numbers 1-1 to 1-25 was obtained. Note that, in the present examples, 0.2% offset proof stress was obtained in the tensile test was defined as the YS for Test Numbers 1-1 to 1-25. The obtained yield strength "YS (MPa)" is shown in Table 2.

[Dislocation Density Measurement Test]

Test specimens for use for dislocation density measurement by the aforementioned method were taken from the steel plate of Test Numbers 1-1 to 1-25. In addition, the dislocation density ($m^{-2}$) was determined by the aforementioned method. The determined dislocation density is shown in Table 2 as a dislocation density ρ ($\times 10^{14}$ $m^{-2}$).

[Coarse Precipitates Number Density Measurement Test]

For the steel plate of Test Numbers 1-1 to 1-25, the number density of precipitates having an equivalent circular diameter of 400 nm or more (coarse precipitates) was measured and calculated by the aforementioned measurement method. Note that, the TEM used was JEM-2010 manufactured by JEOL Ltd., and the acceleration voltage was set to 200 kV. The number density of coarse precipitates (particles/$\mu m^2$) of the steel plate of Test Numbers 1-1 to 1-25 is shown in Table 2.

[Tests to Evaluate SSC Resistance of Steel Material]

The SSC resistance was evaluated with a method in accordance with "Method A" of NACE TM0177-2005 using the steel plate of Test Numbers 1-1 to 1-25. Specifically, round bar test specimens having a diameter of 6.35 mm, and a length of 25.4 mm at the parallel portion were taken from a center portion of the thickness of the steel plate of Test Numbers 1-1 to 1-25. A normal-temperature SSC resistance test was performed on three test specimens. A low-temperature SSC resistance test was performed on the other three test specimens. Note that the axial direction of each test specimen was parallel to the rolling direction.

The normal-temperature SSC resistance test was performed as follows. Tensile stress was applied in the axial direction of the round bar test specimens of Test Numbers 1-1 to 1-25. At this time, the applied stress was adjusted so as to be 95% of the actual yield stress of each steel plate. A mixed aqueous solution containing 5.0 mass % of sodium chloride and 0.5 mass % of acetic acid (NACE solution A) was used as the test solution. The test solution at 24° C. was poured into three test vessels, and these were adopted as test baths. The three round bar test specimens to which the stress was applied were immersed individually in mutually different test vessels as the test baths. After each test bath was degassed, $H_2S$ gas at 1 atm was blown into the respective test baths and caused to saturate. The test baths in which the $H_2S$ gas at 1 atm was saturated were held at 24° C. for 720 hours.

After being held for 720 hours, the round bar test specimens of Test Numbers 1-1 to 1-25 were observed to determine whether or not sulfide stress cracking (SSC) had occurred. Specifically, after being held for 720 hours, the round bar test specimens were observed with the naked eye and using a projector with a magnification of ×10. Steel plates for which cracking was not confirmed in all three of the round bar test specimens as the result of the observation were determined as being "E" (Excellent). On the other hand, steel plates for which cracking was confirmed in at least one round bar test specimen were determined as being "NA" (Not Acceptable).

The low-temperature SSC resistance test was performed in accordance with "Method A" specified in NACE TM0177-2005, in a similar manner to the normal-temperature SSC resistance test. In the low-temperature SSC resistance test, the applied stress was adjusted so as to be 95% of the actual yield stress of each steel plate. In a similar manner to the normal-temperature SSC resistance test, NACE solution A was used as the test solution. In addition, the temperature of the test bath was made 4° C. The other conditions were the same as in the normal-temperature SSC resistance test.

After being held for 720 hours, the round bar test specimens of Test Numbers 1-1 to 1-25 were observed to determine whether or not sulfide stress cracking (SSC) had occurred. Specifically, after being held for 720 hours, the round bar test specimens were observed with the naked eye and using a projector with a magnification of ×10. Steel plates for which cracking was not confirmed in all three of the round bar test specimens as the result of the observation were determined as being "E" (Excellent). On the other hand, steel plates for which cracking was confirmed in at least one round bar test specimen were determined as being "NA" (Not Acceptable).

[Test Results]

The test results are shown in Table 2.

Referring to Table 1 and Table 2, the chemical composition of the respective steel plates of Test Numbers 1-1 to 1-15 was appropriate, Fn1 was 3.00 or less, and the yield strength was within the range of 655 to less than 758 MPa (95 ksi grade). In addition, the dislocation density ρ was $1.4\times10^{14}$ ($m^{-2}$) or less, and the number density of coarse precipitates was not more than 0.150 (particles/$\mu m^2$). As a result, the aforementioned steel plates exhibited excellent SSC resistance in the normal-temperature SSC resistance test and in the low-temperature SSC resistance test.

In contrast, in the steel plates of Test Numbers 1-16 and 1-17, Fn1 was more than 3.00. Consequently, the number density of coarse precipitates was more than 0.150 (particles/$\mu m^2$). As a result, the steel plates of Test Numbers 1-16 and 1-17 did not exhibit excellent SSC resistance in the low-temperature SSC resistance test.

In the steel plate of Test Number 1-18, the Cr content was too high. In addition, Fn1 was more than 3.00. Consequently, the number density of coarse precipitates was more than 0.150 (particles/$\mu m^2$). As a result, the steel plate of Test Number 1-18 did not exhibit excellent SSC resistance in the low-temperature SSC resistance test.

For the steel plate of Test Number 1-19, a low-temperature tempering process was performed after performing a high-temperature tempering process. Consequently, the dislocation density ρ was more than $1.4\times10^{14}$ ($m^{-2}$). As a result, the steel plate of Test Number 1-19 did not exhibit excellent SSC resistance in the low-temperature SSC resistance test.

For the steel plate of Test Number 1-20, a low-temperature tempering process was not performed. Consequently, the dislocation density ρ was more than $1.4\times10^{14}$ ($m^{-2}$). As a result, the steel plate of Test Number 1-20 did not exhibit excellent SSC resistance in the low-temperature SSC resistance test.

In the steel plate of Test Number 1-21, the Cr content was too high. In addition, Fn1 was more than 3.00. Furthermore, a low-temperature tempering process was not performed. Consequently, the number density of coarse precipitates was more than 0.150 (particles/$\mu m^2$). In addition, the dislocation density ρ was more than $1.4\times10^{14}$ ($m^{-2}$). As a result, the steel plate of Test Number 1-21 did not exhibit excellent SSC resistance in the low-temperature SSC resistance test.

In the steel plate of Test Number 1-22, the Mn content was too high. As a result, the steel plate of Test Number 1-22 did not exhibit excellent SSC resistance in both the normal-temperature SSC resistance test and the low-temperature SSC resistance test.

In the steel plate of Test Number 1-23, the Cr content was too low. As a result, the steel plate of Test Number 1-23 did not exhibit excellent SSC resistance in both the normal-temperature SSC resistance test and the low-temperature SSC resistance test.

In the steel plate of Test Number 1-24, the Mo content was too low. In addition, Fn1 was more than 3.00. Consequently, the number density of coarse precipitates was more than 0.150 (particles/$\mu m^2$). As a result, the steel plate of Test Number 1-24 did not exhibit excellent SSC resistance in both the normal-temperature SSC resistance test and the low-temperature SSC resistance test.

In the steel plate of Test Number 1-25, the C content was too high. Consequently, the number density of coarse precipitates was more than 0.150 (particles/$\mu m^2$). As a result, the steel plate of Test Number 1-25 did not exhibit excellent SSC resistance in the low-temperature SSC resistance test.

Example 2

In Example 2, in a case where the yield strength of the steel material is of 110 ksi grade (758 to less than 862 MPa), the SSC resistance in a normal-temperature sour environment and a low-temperature sour environment was investigated. Specifically, molten steels of a weight of 180 kg having the chemical compositions shown in Table 3 were produced. In addition, Fn1 that was determined based on the obtained chemical composition and Formula (1) is shown in Table 4.

TABLE 3

| Test | Chemical Composition (Unit is mass %; balance is Fe and impurities) | | | | | | | | | | | |
|---|---|---|---|---|---|---|---|---|---|---|---|---|
| Number | C | Si | Mn | P | S | Al | Cr | Mo | Ti | B | N | O |
| 2-1 | 0.29 | 0.23 | 0.39 | 0.007 | 0.0006 | 0.049 | 0.74 | 1.18 | 0.010 | 0.0015 | 0.0036 | 0.0017 |
| 2-2 | 0.27 | 0.27 | 0.04 | 0.012 | 0.0006 | 0.039 | 0.71 | 0.85 | 0.011 | 0.0013 | 0.0036 | 0.0016 |
| 2-3 | 0.30 | 0.24 | 0.11 | 0.008 | 0.0007 | 0.046 | 0.76 | 1.23 | 0.011 | 0.0014 | 0.0030 | 0.0019 |
| 2-4 | 0.26 | 0.34 | 0.18 | 0.007 | 0.0006 | 0.028 | 0.73 | 0.94 | 0.014 | 0.0013 | 0.0023 | 0.0013 |
| 2-5 | 0.28 | 0.26 | 0.21 | 0.007 | 0.0009 | 0.046 | 0.76 | 1.21 | 0.010 | 0.0015 | 0.0036 | 0.0011 |
| 2-6 | 0.27 | 0.29 | 0.39 | 0.010 | 0.0008 | 0.036 | 0.76 | 0.92 | 0.011 | 0.0012 | 0.0039 | 0.0010 |
| 2-7 | 0.24 | 0.30 | 0.43 | 0.011 | 0.0008 | 0.035 | 0.61 | 1.02 | 0.015 | 0.0011 | 0.0025 | 0.0011 |
| 2-8 | 0.26 | 0.27 | 0.38 | 0.006 | 0.0009 | 0.044 | 0.63 | 1.44 | 0.011 | 0.0011 | 0.0031 | 0.0018 |
| 2-9 | 0.26 | 0.33 | 0.37 | 0.008 | 0.0010 | 0.028 | 0.51 | 0.94 | 0.009 | 0.0012 | 0.0047 | 0.0018 |
| 2-10 | 0.24 | 0.33 | 0.42 | 0.011 | 0.0006 | 0.037 | 0.66 | 1.00 | 0.011 | 0.0015 | 0.0031 | 0.0006 |
| 2-11 | 0.25 | 0.26 | 0.46 | 0.011 | 0.0006 | 0.033 | 0.53 | 1.42 | 0.014 | 0.0011 | 0.0041 | 0.0007 |
| 2-12 | 0.26 | 0.25 | 0.41 | 0.012 | 0.0010 | 0.038 | 0.55 | 0.97 | 0.010 | 0.0014 | 0.0034 | 0.0014 |
| 2-13 | 0.27 | 0.33 | 0.35 | 0.011 | 0.0008 | 0.034 | 0.46 | 1.27 | 0.014 | 0.0015 | 0.0023 | 0.0017 |
| 2-14 | 0.28 | 0.25 | 0.41 | 0.012 | 0.0007 | 0.028 | 0.72 | 0.85 | 0.013 | 0.0013 | 0.0045 | 0.0018 |
| 2-15 | 0.29 | 0.33 | 0.42 | 0.010 | 0.0010 | 0.054 | 0.46 | 0.84 | 0.011 | 0.0013 | 0.0026 | 0.0012 |
| 2-16 | 0.26 | 0.29 | 0.46 | 0.008 | 0.0008 | 0.044 | 0.56 | 1.01 | 0.014 | 0.0011 | 0.0046 | 0.0006 |
| 2-17 | 0.28 | 0.32 | 0.45 | 0.009 | 0.0006 | 0.039 | 0.46 | 1.41 | 0.013 | 0.0013 | 0.0033 | 0.0014 |
| 2-18 | 0.30 | 0.22 | 0.36 | 0.009 | 0.0006 | 0.053 | 0.77 | 0.61 | 0.014 | 0.0015 | 0.0023 | 0.0012 |
| 2-19 | 0.24 | 0.34 | 0.36 | 0.008 | 0.0009 | 0.036 | 0.79 | 0.50 | 0.006 | 0.0011 | 0.0040 | 0.0006 |
| 2-20 | 0.29 | 0.27 | 0.47 | 0.011 | 0.0007 | 0.041 | 1.02 | 0.60 | 0.011 | 0.0013 | 0.0032 | 0.0016 |
| 2-21 | 0.25 | 0.28 | 0.65 | 0.009 | 0.0009 | 0.041 | 0.63 | 0.84 | 0.014 | 0.0012 | 0.0029 | 0.0008 |
| 2-22 | 0.30 | 0.22 | 0.44 | 0.011 | 0.0009 | 0.029 | 0.53 | 1.17 | 0.009 | 0.0015 | 0.0029 | 0.0009 |
| 2-23 | 0.25 | 0.26 | 0.51 | 0.006 | 0.0007 | 0.025 | 1.00 | 1.01 | 0.017 | 0.0015 | 0.0023 | 0.0016 |
| 2-24 | 0.25 | 0.27 | 1.31 | 0.011 | 0.0008 | 0.025 | 0.76 | 0.84 | 0.010 | 0.0015 | 0.0032 | 0.0013 |
| 2-25 | 0.28 | 0.33 | 0.41 | 0.007 | 0.0008 | 0.031 | 0.11 | 0.87 | 0.011 | 0.0012 | 0.0026 | 0.0011 |
| 2-26 | 0.30 | 0.27 | 0.42 | 0.008 | 0.0007 | 0.052 | 0.65 | 0.12 | 0.010 | 0.0015 | 0.0030 | 0.0008 |
| 2-27 | 0.59 | 0.32 | 0.43 | 0.012 | 0.0007 | 0.048 | 0.75 | 1.11 | 0.014 | 0.0011 | 0.0036 | 0.0014 |

| Test | Chemical Composition (Unit is mass %; balance is Fe and impurities) | | | | | | | | | |
|---|---|---|---|---|---|---|---|---|---|---|
| Number | V | Nb | Ca | Mg | Zr | Co | W | Ni | Cu | Nd |
| 2-1 | — | — | — | — | — | — | — | — | — | — |
| 2-2 | — | — | — | — | — | — | — | — | — | — |
| 2-3 | — | — | — | — | — | — | — | — | — | — |
| 2-4 | — | — | — | — | — | — | — | — | — | — |
| 2-5 | — | — | — | — | — | — | — | — | — | — |
| 2-6 | — | — | — | — | — | — | — | — | — | — |
| 2-7 | — | — | — | — | — | — | — | — | — | — |
| 2-8 | 0.09 | — | — | — | — | — | — | — | — | — |
| 2-9 | — | 0.013 | — | — | — | — | — | — | — | — |
| 2-10 | — | — | 0.0023 | — | — | — | — | — | — | — |
| 2-11 | — | — | — | 0.0022 | — | — | — | — | — | — |
| 2-12 | — | — | — | — | 0.0016 | — | — | — | — | — |
| 2-13 | — | — | — | — | — | 0.31 | — | — | — | — |
| 2-14 | — | — | — | — | — | — | 0.32 | — | — | — |
| 2-15 | — | — | — | — | — | — | — | 0.05 | — | — |
| 2-16 | — | — | — | — | — | — | — | — | 0.22 | — |
| 2-17 | — | — | — | — | — | — | — | — | — | 0.0025 |
| 2-18 | — | — | — | — | — | — | — | — | — | — |
| 2-19 | — | — | — | — | — | — | — | — | — | — |
| 2-20 | 0.10 | — | — | — | — | — | — | — | — | — |
| 2-21 | — | 0.012 | — | — | — | — | — | — | — | — |
| 2-22 | — | — | — | — | — | — | — | — | — | — |
| 2-23 | 0.03 | 0.020 | — | — | — | — | — | — | 0.06 | — |
| 2-24 | — | — | — | — | — | — | — | — | — | — |
| 2-25 | — | — | — | — | — | — | — | — | — | — |
| 2-26 | — | — | — | — | — | — | — | — | — | — |
| 2-27 | — | — | — | — | — | — | — | — | — | — |

TABLE 4

| Test Number | Fn1 | First Tempering: Tempering Temperature (° C.) | First Tempering: Tempering Time (min) | Second Tempering: Tempering Temperature (° C.) | Second Tempering: Tempering Time (min) | YS (MPa) | Dislocation Density ρ ($\times 10^{14} \times m^{-2}$) | Number Density of Coarse Precipitates (particles/$\mu m^2$) | SSC Resistance: 1atm $K_2S$ (24° C.) | SSC Resistance: 1atm $H_2S$ (4° C.) |
|---|---|---|---|---|---|---|---|---|---|---|
| 2-1 | 2.50 | 300 | 20 | 700 | 45 | 809 | 2.1 | 0.016 | E | E |
| 2-2 | 2.68 | 300 | 20 | 700 | 45 | 807 | 2.0 | 0.078 | E | E |
| 2-3 | 2.55 | 300 | 20 | 700 | 45 | 810 | 2.1 | 0.047 | E | E |
| 2-4 | 2.68 | 300 | 20 | 700 | 45 | 799 | 2.0 | 0.063 | E | E |
| 2-5 | 2.57 | 300 | 20 | 700 | 45 | 806 | 2.1 | 0.031 | E | E |
| 2-6 | 2.86 | 300 | 20 | 700 | 45 | 804 | 2.0 | 0.047 | E | E |
| 2-7 | 2.00 | 200 | 50 | 690 | 45 | 847 | 2.6 | 0.094 | E | E |
| 2-8 | 1.51 | 400 | 15 | 720 | 45 | 760 | 1.5 | 0.016 | E | E |
| 2-9 | 1.59 | 250 | 20 | 720 | 30 | 765 | 1.6 | 0.000 | E | E |
| 2-10 | 2.28 | 250 | 20 | 710 | 30 | 759 | 1.5 | 0.047 | E | E |
| 2-11 | 1.20 | 200 | 30 | 700 | 30 | 812 | 2.2 | 0.000 | E | E |
| 2-12 | 1.76 | 200 | 30 | 700 | 80 | 782 | 1.8 | 0.000 | E | E |
| 2-13 | 1.00 | 200 | 60 | 710 | 30 | 762 | 1.5 | 0.047 | E | E |
| 2-14 | 2.72 | 200 | 40 | 700 | 60 | 799 | 1.9 | 0.094 | E | E |
| 2-15 | 1.44 | 200 | 40 | 700 | 45 | 802 | 2.0 | 0.078 | E | E |
| 2-16 | 1.76 | 200 | 35 | 700 | 90 | 778 | 1.7 | 0.047 | E | E |
| 2-17 | 0.86 | 200 | 35 | 710 | 30 | 767 | 1.6 | 0.000 | E | E |
| 2-18 | 3.21 | 200 | 35 | 700 | 50 | 815 | 2.2 | 0.172 | E | NA |
| 2-19 | 3.44 | 200 | 35 | 700 | 50 | 802 | 2.1 | 0.219 | E | NA |
| 2-20 | 4.28 | 200 | 35 | 710 | 50 | 811 | 2.1 | 0.297 | E | NA |
| 2-21 | 2.28 | 710 | 40 | 550 | 80 | 819 | 5.7 | 0.063 | E | NA |
| 2-22 | 1.46 | 700 | 60 | — | — | 816 | 5.5 | 0.047 | E | NA |
| 2-23 | 3.90 | 720 | 45 | — | — | 761 | 3.5 | 0.250 | E | NA |
| 2-24 | 2.94 | 200 | 20 | 700 | 45 | 817 | 2.3 | 0.078 | NA | NA |
| 2-25 | −0.34 | 200 | 20 | 700 | 50 | 794 | 2.2 | 0.109 | NA | NA |
| 2-26 | 3.11 | 200 | 20 | 700 | 30 | 791 | 2.2 | 0.156 | NA | NA |
| 2-27 | 2.61 | 200 | 20 | 720 | 60 | 825 | 2.0 | 0.203 | E | NA |

Ingots were produced using the aforementioned molten steels. The ingots were hot roiled to produce steel plates having a thickness of 15 mm.

Steel plates of Test Numbers 2-1 to 2-27 after hot rolling were allowed to cool to bring the steel plate temperature to normal temperature (25° C.). Next, after being allowed to cool, the steel plates of Test Numbers 2-1 to 2-27 were subjected to quenching. Note that, a type K thermocouple of a sheath type was inserted into a center portion of the thickness of the steel plate in advance, and the quenching temperature and cooling rate during quenching were measured using the type K thermocouple.

The steel plates of Test Numbers 2-1 to 2-27 were subjected to quenching once. Specifically, after being allowed to cool as described above, the steel plate was reheated and the steel plate temperature was adjusted so as to become the quenching temperature (920° C.), and the steel plate was held for 20 minutes. Thereafter, water cooling was performed using a shower-type water cooling apparatus. The average cooling rate from 800° C. to 500° C. during quenching of the steel plates of Test Numbers 2-1 to 2-27, that is, the cooling rate during quenching ($CR_{800-500}$) (° C./sec), was 10° C./sec.

After quenching, the steel plates of Test Numbers 2-1 to 2-27 were subjected to a tempering process. For the steel plates of Test Numbers 2-1 to 2-21 and 2-24 to 2-27, a first tempering and a second tempering were performed. On the other hand, for the steel plates of Test Numbers 2-22 and 2-23, a tempering was performed only once. A tempering temperature (° C.) and tempering time (min) for each of the first tempering and the second tempering are shown in Table 4. Note that, the tempering temperature in the present examples was brought to the temperature of the furnace in which tempering was performed. The tempering time in the present examples was taken as the period of time from the temperature of the steel plate of each test number reaching a predetermined tempering temperature till the extracting from the furnace.

[Evaluation Tests]

A tensile test, a dislocation density measurement test, a coarse precipitates number density measurement test, and an SSC resistance evaluation test that are described hereunder were performed on the steel plate of Test Numbers 2-1 to 2-27 after the aforementioned tempering process.

[Tensile Test]

A tensile test was performed in conformity with ASTM E8/E8M (2013). Round bar test specimens having a parallel portion diameter of 4 mm and a parallel portion length of 35 mm were prepared from the center portion of the thickness of the steel plate of Test Numbers 2-1 to 2-27. The axial direction of the round bar test specimens was parallel to the rolling direction of the steel plate. A tensile test was performed in the atmosphere at normal temperature (25° C.) using each round bar test specimen, and the yield strength (MPa) of the steel plate of Test Numbers 2-1 to 2-27 was obtained. Note that, in the present examples, 0.2% offset proof stress was obtained in the tensile test was defined as the YS for Test Numbers 2-1 to 2-27. The obtained yield strength "YS (MPa)" is shown in Table 4.

[Dislocation Density Measurement Test]

Test specimens for use for dislocation density measurement by the aforementioned method were taken from the steel plate of Test Numbers 2-1 to 2-27. In addition, the dislocation density ($m^{-2}$) was determined by the aforementioned method. The determined dislocation density is shown in Table 4 as a dislocation density ρ ($\times 10^{14}$ $m^{-2}$).

[Coarse Precipitates Number Density Measurement Test]

For the steel plate of Test Numbers 2-1 to 2-27, the number density of precipitates having an equivalent circular diameter of 400 nm or more (coarse precipitates) was measured and calculated by the aforementioned measurement method. Note that, the TEM used was JEM-2010 manufactured by JEOL Ltd., and the acceleration voltage was set to 200 kV. The number density of coarse precipitates (particles/$\mu m^2$) of the steel plate of Test Numbers 2-1 to 2-27 is shown in Table 4.

[Tests to Evaluate SSC Resistance of Steel Material]

The SSC resistance was evaluated with a method in accordance with "Method A" of NACE TM0177-2005 using the steel plate of Test Numbers 2-1 to 2-27. Specifically, round bar test specimens having a diameter of 6.35 mm, and a length of 25.4 mm at the parallel portion were taken from a center portion of the thickness of the steel plate of Test Numbers 2-1 to 2-27. A normal-temperature SSC resistance test was performed on three test specimens. A low-temperature SSC resistance test was performed on the other three test specimens. Note that the axial direction of each test specimen was parallel to the rolling direction.

The normal-temperature SSC resistance test was performed as follows. Tensile stress was applied in the axial direction of the round bar test specimens of Test Numbers 2-1 to 2-27. At this time, the applied stress was adjusted so as to be 90% of the actual yield stress of each steel plate. A mixed aqueous solution containing 5.0 mass % of sodium chloride and 0.5 mass % of acetic acid (NACE solution A) was used as the test solution. The test solution at 24° C. was poured into three test vessels, and these were adopted as test baths. The three round bar test specimens to which the stress was applied were immersed individually in mutually different test vessels as the test baths. After each test bath was degassed, $H_2S$ gas at 1 atm was blown into the respective test baths and caused to saturate. The test baths in which the $H_2S$ gas at 1 atm was saturated were held at 24° C. for 720 hours.

After being held for 720 hours, the round bar test specimens of Test Numbers 2-1 to 2-27 were observed to determine whether or not sulfide stress cracking (SSC) had occurred. Specifically, after being held for 720 hours, the round bar test specimens were observed with the naked eye and using a projector with a magnification of ×10. Steel plates for which cracking was not confirmed in all three of the round bar test specimens as the result of the observation were determined as being "E" (Excellent). On the other hand, steel plates for which cracking was confirmed in at least one round bar test specimen were determined as being "NA" (Not Acceptable).

The low-temperature SSC resistance test was performed in accordance with "Method A" specified in NACE TM0177-2005, in a similar manner to the normal-temperature SSC resistance test. In the low-temperature SSC resistance test, the applied stress was adjusted so as to be 85% of the actual yield stress of each steel plate. In a similar manner to the normal-temperature SSC resistance test, NACE solution A was used as the test solution. In addition, the temperature of the test bath was made 4° C. The other conditions were the same as in the normal-temperature SSC resistance test.

After being held for 720 hours, the round bar test specimens of Test Numbers 2-1 to 2-27 were observed to determine whether or not sulfide stress cracking (SSC) had occurred. Specifically, after being held for 720 hours, the round bar test specimens were observed with the naked eye and using a projector with a magnification of ×10. Steel plates for which cracking was not confirmed in all three of the round bar test specimens as the result of the observation were determined as being "E" (Excellent). On the other hand, steel plates for which cracking was confirmed in at least one round bar test specimen were determined as being "NA" (Not Acceptable).

[Test Results]

The test results are shown in Table 4.

Referring to Table 3 and Table 4, the chemical composition of the respective steel plates of Test Numbers 2-1 to 2-17 was appropriate, Fn1 was 3.00 or less, and the yield strength was within the range of 758 to less than 862 MPa (110 ksi grade). In addition, the dislocation density ρ was within a range of more than $1.4\times10^{1}$ to less than $3.0\times10^{14}$ ($m^{-2}$), and the number density of coarse precipitates was not more than 0.150 (particles/$\mu m^2$). As a result, the aforementioned steel plates exhibited excellent SSC resistance in the normal-temperature SSC resistance test and in the low-temperature SSC resistance test.

In contrast, in the steel plates of Test Numbers 2-18 and 2-19, Fn1 was more than 3.00. Consequently, the number density of coarse precipitates was more than 0.150 (particles/$\mu m^2$). As a result, the steel plates of Test Numbers 2-18 and 2-19 did not exhibit excellent SSC resistance in the low-temperature SSC resistance test.

In the steel plate of Test Number 2-20, the Cr content was too high. In addition, Fn1 was more than 3.00. Consequently, the number density of coarse precipitates was more than 0.150 (particles/$\mu m^2$). As a result, the steel plate of Test Number 2-20 did not exhibit excellent SSC resistance in the low-temperature SSC resistance test.

For the steel plate of Test Number 2-21, a low-temperature tempering process was performed after performing a high-temperature tempering process. Consequently, the dislocation density ρ was $3.0\times10^{14}$ ($m^{-2}$) or more. As a result, the steel plate of Test Number 2-21 did not exhibit excellent SSC resistance in the low-temperature SSC resistance test.

For the steel plate of Test Number 2-22, a low-temperature tempering process was not performed. Consequently, the dislocation density ρ was $3.0\times10^{14}$ ($m^{-2}$) or more. As a result, the steel plate of Test Number 2-22 did not exhibit excellent SSC resistance in the low-temperature SSC resistance test.

In the steel plate of Test Number 2-23, the Cr content was too high. In addition, Fn1 was more than 3.00. Furthermore, a low-temperature tempering process was not performed. Consequently, the number density of coarse precipitates was more than 0.150 (particles/$\mu m^2$). In addition, the dislocation density ρ was $3.0\times10^{14}$ ($m^{-2}$) or more. As a result, the steel plate of Test Number 2-23 did not exhibit excellent SSC resistance in the low-temperature SSC resistance test.

In the steel plate of Test Number 2-24, the Mn content was too high. As a result, the steel plate of Test Number 2-24 did not exhibit excellent SSC resistance in both the normal-temperature SSC resistance test and the low-temperature SSC resistance test.

In the steel plate of Test Number 2-25, the Cr content was too low. As a result, the steel plate of Test Number 2-25 did not exhibit excellent SSC resistance in both the normal-temperature SSC resistance test and the low-temperature SSC resistance test.

In the steel plate of Test Number 2-26, the Mo content was too low. In addition, Fn1 was more than 3.00. Consequently, the number density of coarse precipitates was more than 0.150 (particles/$\mu m^2$). As a result, the steel plate of Test Number 2-26 did not exhibit excellent SSC resistance in both the normal-temperature SSC resistance test and the low-temperature SSC resistance test.

In the steel plate of Test Number 2-27, the C content was too high. Consequently, the number density of coarse precipitates was more than 0.150 (particles/μm$^2$). As a result, the steel plate of Test Number 2-27 did not exhibit excellent SSC resistance in the low-temperature SSC resistance test.

Example 3

In Example 3, in a case where the yield strength of the steel material is of 125 ksi grade (862 to 965 MPa), the SSC resistance in a normal-temperature sour environment and a low-temperature sour environment was investigated. Specifically, molten steels of a weight of 180 kg having the chemical compositions shown in Table 5 were produced. In addition, Fn1 that was determined based on the obtained chemical composition and Formula (1) is shown in Table 6.

TABLE 5

| Test | Chemical Composition (Unit is mass %; balance is Fe and impurities) | | | | | | | | | | | |
|---|---|---|---|---|---|---|---|---|---|---|---|---|
| Number | C | Si | Mn | P | S | Al | Cr | Mo | Ti | B | N | O |
| 3-1 | 0.30 | 0.26 | 0.03 | 0.009 | 0.0007 | 0.049 | 0.69 | 1.29 | 0.014 | 0.0015 | 0.0028 | 0.0006 |
| 3-2 | 0.30 | 0.32 | 0.09 | 0.006 | 0.0006 | 0.028 | 0.52 | 1.36 | 0.014 | 0.0013 | 0.0031 | 0.0008 |
| 3-3 | 0.29 | 0.23 | 0.15 | 0.011 | 0.0010 | 0.050 | 0.48 | 1.14 | 0.015 | 0.0015 | 0.0036 | 0.0009 |
| 3-4 | 0.25 | 0.33 | 0.20 | 0.010 | 0.0007 | 0.048 | 0.74 | 0.89 | 0.010 | 0.0015 | 0.0032 | 0.0006 |
| 3-5 | 0.30 | 0.34 | 0.35 | 0.009 | 0.0007 | 0.034 | 0.64 | 1.14 | 0.013 | 0.0013 | 0.0024 | 0.0011 |
| 3-6 | 0.25 | 0.34 | 0.39 | 0.007 | 0.0006 | 0.046 | 0.65 | 0.81 | 0.010 | 0.0011 | 0.0045 | 0.0007 |
| 3-7 | 0.24 | 0.24 | 0.36 | 0.007 | 0.0008 | 0.047 | 0.47 | 0.87 | 0.014 | 0.0012 | 0.0034 | 0.0007 |
| 3-8 | 0.27 | 0.22 | 0.34 | 0.007 | 0.0009 | 0.045 | 0.59 | 1.28 | 0.012 | 0.0015 | 0.0031 | 0.0008 |
| 3-9 | 0.29 | 0.29 | 0.17 | 0.012 | 0.0007 | 0.043 | 0.63 | 1.08 | 0.014 | 0.0015 | 0.0038 | 0.0015 |
| 3-10 | 0.28 | 0.34 | 0.16 | 0.009 | 0.0009 | 0.054 | 0.58 | 1.21 | 0.014 | 0.0013 | 0.0029 | 0.0018 |
| 3-11 | 0.29 | 0.22 | 0.16 | 0.010 | 0.0007 | 0.044 | 0.59 | 0.90 | 0.014 | 0.0011 | 0.0031 | 0.0019 |
| 3-12 | 0.27 | 0.32 | 0.41 | 0.007 | 0.0010 | 0.050 | 0.75 | 1.25 | 0.010 | 0.0015 | 0.0027 | 0.0006 |
| 3-13 | 0.24 | 0.29 | 0.18 | 0.011 | 0.0010 | 0.028 | 0.71 | 0.99 | 0.012 | 0.0015 | 0.0034 | 0.0019 |
| 3-14 | 0.26 | 0.31 | 0.16 | 0.011 | 0.0010 | 0.046 | 0.57 | 0.90 | 0.013 | 0.0011 | 0.0042 | 0.0012 |
| 3-15 | 0.25 | 0.23 | 0.45 | 0.010 | 0.0008 | 0.055 | 0.47 | 0.91 | 0.013 | 0.0013 | 0.0027 | 0.0007 |
| 3-16 | 0.25 | 0.30 | 0.38 | 0.009 | 0.0007 | 0.042 | 0.78 | 0.61 | 0.010 | 0.0014 | 0.0039 | 0.0011 |
| 3-17 | 0.24 | 0.33 | 0.27 | 0.006 | 0.0009 | 0.053 | 0.80 | 0.52 | 0.008 | 0.0015 | 0.0044 | 0.0010 |
| 3-18 | 0.26 | 0.34 | 0.42 | 0.011 | 0.0006 | 0.031 | 1.07 | 0.96 | 0.014 | 0.0012 | 0.0038 | 0.0008 |
| 3-19 | 0.25 | 0.33 | 0.15 | 0.008 | 0.0006 | 0.036 | 0.65 | 0.81 | 0.010 | 0.0014 | 0.0025 | 0.0010 |
| 3-20 | 0.30 | 0.27 | 0.28 | 0.010 | 0.0007 | 0.052 | 0.52 | 0.94 | 0.010 | 0.0013 | 0.0022 | 0.0006 |
| 3-21 | 0.27 | 0.28 | 0.25 | 0.011 | 0.0008 | 0.033 | 1.00 | 0.85 | 0.014 | 0.0012 | 0.0042 | 0.0006 |
| 3-22 | 0.30 | 0.29 | 1.35 | 0.006 | 0.0007 | 0.043 | 0.45 | 0.97 | 0.014 | 0.0015 | 0.0043 | 0.0018 |
| 3-23 | 0.27 | 0.34 | 0.40 | 0.011 | 0.0009 | 0.033 | 0.03 | 1.21 | 0.014 | 0.0011 | 0.0022 | 0.0012 |
| 3-24 | 0.28 | 0.35 | 0.44 | 0.011 | 0.0006 | 0.049 | 0.63 | 0.12 | 0.011 | 0.0013 | 0.0030 | 0.0010 |
| 3-25 | 0.58 | 0.35 | 0.37 | 0.007 | 0.0008 | 0.053 | 0.57 | 0.81 | 0.015 | 0.0014 | 0.0048 | 0.0018 |

| Test | Chemical Composition (Unit is mass %; balance is Fe and impurities) | | | | | | | | | |
|---|---|---|---|---|---|---|---|---|---|---|
| Number | V | Nb | Ca | Mg | Zr | Co | W | Ni | Cu | Nd |
| 3-1 | — | — | — | — | — | — | — | — | — | — |
| 3-2 | — | — | — | — | — | — | — | — | — | — |
| 3-3 | — | — | — | — | — | — | — | — | — | — |
| 3-4 | — | — | — | — | — | — | — | — | — | — |
| 3-5 | — | — | — | — | — | — | — | — | — | — |
| 3-6 | 0.11 | — | — | — | — | — | — | — | — | — |
| 3-7 | — | 0.017 | — | — | — | — | — | — | — | — |
| 3-8 | — | — | 0.0018 | — | — | — | — | — | — | — |
| 3-9 | — | — | — | 0.0019 | — | — | — | — | — | — |
| 3-10 | — | — | — | — | 0.0015 | — | — | — | — | — |
| 3-11 | — | — | — | — | — | 0.33 | — | — | — | — |
| 3-12 | — | — | — | — | — | — | 0.31 | — | — | — |
| 3-13 | — | — | — | — | — | — | — | 0.04 | — | — |
| 3-14 | — | — | — | — | — | — | — | — | 0.19 | — |
| 3-15 | — | — | — | — | — | — | — | — | — | 0.0021 |
| 3-16 | — | — | — | — | — | — | — | — | — | — |
| 3-17 | — | — | — | — | — | — | — | — | — | — |
| 3-18 | 0.10 | — | — | — | — | — | — | — | — | — |
| 3-19 | — | 0.011 | — | — | — | — | — | — | — | — |
| 3-20 | — | — | — | — | — | — | — | — | — | — |
| 3-21 | 0.04 | 0.019 | — | — | — | — | — | — | 0.05 | — |
| 3-22 | — | — | — | — | — | — | — | — | — | — |
| 3-23 | — | — | — | — | — | — | — | — | — | — |
| 3-24 | — | — | — | — | — | — | — | — | — | — |
| 3-25 | — | — | — | — | — | — | — | — | — | — |

TABLE 6

| Test Number | Fn1 | First Tempering: Tempering Temperature (° C.) | First Tempering: Tempering Time (min) | Second Tempering: Tempering Temperature (° C.) | Second Tempering: Tempering Time (min) | YS (MPa) | Dislocation Density ρ ($\times 10^{14} \times m^{-2}$) | Number Density of Coarse Precipitates (particles/$pm^2$) | SSC Resistance: 1atm $K_2S$ (24° C.) | SSC Resistance: 1atm $H_2S$ (4° C.) |
|---|---|---|---|---|---|---|---|---|---|---|
| 3-1 | 2.13 | 300 | 20 | 680 | 45 | 892 | 5.6 | 0.031 | E | E |
| 3-2 | 1.21 | 300 | 20 | 680 | 45 | 890 | 5.4 | 0.031 | E | E |
| 3-3 | 1.23 | 300 | 20 | 680 | 45 | 889 | 5.3 | 0.047 | E | E |
| 3-4 | 2.79 | 300 | 20 | 680 | 45 | 874 | 4.2 | 0.063 | E | E |
| 3-5 | 2.03 | 200 | 50 | 680 | 45 | 890 | 5.4 | 0.063 | E | E |
| 3-6 | 2.20 | 400 | 15 | 680 | 45 | 933 | 6.2 | 0.000 | E | E |
| 3-7 | 1.45 | 250 | 20 | 690 | 30 | 889 | 5.5 | 0.016 | E | E |
| 3-8 | 1.65 | 250 | 20 | 690 | 30 | 863 | 3.5 | 0.031 | E | E |
| 3-9 | 2.04 | 200 | 30 | 690 | 30 | 865 | 3.7 | 0.000 | E | E |
| 3-10 | 1.66 | 200 | 30 | 680 | 80 | 874 | 4.0 | 0.016 | E | E |
| 3-11 | 2.02 | 200 | 60 | 680 | 30 | 902 | 5.7 | 0.078 | E | E |
| 3-12 | 2.48 | 200 | 40 | 680 | 60 | 887 | 5.3 | 0.078 | E | E |
| 3-13 | 2.54 | 200 | 40 | 680 | 45 | 890 | 5.5 | 0.063 | E | E |
| 3-14 | 1.92 | 200 | 35 | 670 | 90 | 909 | 5.8 | 0.031 | E | E |
| 3-15 | 1.41 | 200 | 35 | 680 | 30 | 899 | 5.6 | 0.016 | E | E |
| 3-16 | 3.27 | 200 | 35 | 680 | 50 | 886 | 5.3 | 0.188 | E | NA |
| 3-17 | 3.46 | 200 | 35 | 680 | 50 | 885 | 5.2 | 0.234 | E | NA |
| 3-18 | 4.16 | 200 | 35 | 680 | 50 | 935 | 6.3 | 0.344 | E | NA |
| 3-19 | 2.42 | 680 | 40 | 550 | 80 | 941 | 9.3 | 0.109 | E | NA |
| 3-20 | 1.64 | 680 | 40 | — | — | 899 | 7.5 | 0.125 | E | NA |
| 3-21 | 4.04 | 680 | 80 | — | — | 911 | 7.8 | 0.266 | E | NA |
| 3-22 | 1.25 | 200 | 20 | 680 | 45 | 891 | 5.6 | 0.109 | NA | NA |
| 3-23 | −1.09 | 200 | 20 | 680 | 50 | 876 | 4.4 | 0.078 | NA | NA |
| 3-24 | 3.01 | 200 | 20 | 680 | 30 | 877 | 4.4 | 0.156 | NA | NA |
| 3-25 | 2.01 | 200 | 20 | 700 | 60 | 880 | 4.5 | 0.188 | E | NA |

Ingots were produced using the aforementioned molten steels. The ingots were hot rolled to produce steel plates having a thickness of 15 mm.

Steel plates of Test Numbers 3-1 to 3-25 after hot rolling were allowed to cool to bring the steel plate temperature to normal temperature (25° C.). Next, after being allowed to cool, the steel plates of Test Numbers 3-1 to 3-25 were subjected to quenching. Note that, a type K thermocouple of a sheath type was inserted into a center portion of the thickness of the steel plate in advance, and the quenching temperature and cooling rate during quenching were measured using the type K thermocouple.

The steel plates of Test Numbers 3-1 to 3-25 were subjected to quenching once. Specifically, after being allowed to cool as described above, the steel plate was reheated and the steel plate temperature was adjusted so as to become the quenching temperature (920° C.), and the steel plate was held for 20 minutes. Thereafter, water cooling was performed using a shower-type water cooling apparatus. The average cooling rate from 800° C. to 500° C. during quenching of the steel plates of Test Numbers 3-1 to 3-25, that is, the cooling rate during quenching ($CR_{800-500}$) (° C./sec), was 10° C./sec.

After quenching, the steel plates of Test Numbers 3-1 to 3-25 were subjected to a tempering process. For the steel plates of Test Numbers 3-1 to 3-19 and 3-22 to 3-25, a first tempering and a second tempering were performed. On the other hand, for the steel plates of Test Numbers 3-20 and 3-21, a tempering was performed only once. A tempering temperature (° C.) and tempering time (min) for each of the first tempering and the second tempering are shown in Table 6. Note that, the tempering temperature in the present examples was brought to the temperature of the furnace in which tempering was performed. The tempering time in the present examples was taken as the period of time from the temperature of the steel plate of each test number reaching a predetermined tempering temperature till the extracting from the furnace.

[Evaluation Tests]

A tensile test, a dislocation density measurement test, a coarse precipitates number density measurement test, and an SSC resistance evaluation test that are described hereunder were performed on the steel plate of Test Numbers 3-1 to 3-25 after the aforementioned tempering process.

[Tensile Test]

A tensile test was performed in conformity with ASTM E8/E8M (2013). Round bar test specimens having a parallel portion diameter of 4 mm and a parallel portion length of 35 mm were prepared from the center portion of the thickness of the steel plate of Test Numbers 3-1 to 3-25. The axial direction of the round bar test specimens was parallel to the rolling direction of the steel plate. A tensile test was performed in the atmosphere at normal temperature (25° C.) using each round bar test specimen, and the yield strength (MPa) of the steel plate of Test Numbers 3-1 to 3-25 was obtained. Note that, in the present examples, 0.2% offset proof stress was obtained in the tensile test was defined as the YS for Test Numbers 3-1 to 3-25. The obtained yield strength "YS (MPa)" is shown in Table 6.

[Dislocation Density Measurement Test]

Test specimens for use for dislocation density measurement by the aforementioned method were taken from the steel plate of Test Numbers 3-1 to 3-25. In addition, the dislocation density ($m^{-2}$) was determined by the aforementioned method. The determined dislocation density is shown in Table 6 as a dislocation density ρ ($\times 10^{14}$ $m^{-2}$).

[Coarse Precipitates Number Density Measurement Test]

For the steel plate of Test Numbers 3-1 to 3-25, the number density of precipitates having an equivalent circular diameter of 400 nm or more (coarse precipitates) was measured and calculated by the aforementioned measurement method. Note that, the TEM used was JEM-2010 manufactured by JEOL Ltd., and the acceleration voltage was set to 200 kV. The number density of coarse precipitates (particles/$\mu m^2$) of the steel plate of Test Numbers 3-1 to 3-25 is shown in Table 6.

[Tests to Evaluate SSC Resistance of Steel Material]

The SSC resistance was evaluated with a method in accordance with "Method A" of NACE TM0177-2005 using the steel plate of Test Numbers 3-1 to 3-25. Specifically, round bar test specimens having a diameter of 6.35 mm, and a length of 25.4 mm at the parallel portion were taken from a center portion of the thickness of the steel plate of Test Numbers 3-1 to 3-25. A normal-temperature SSC resistance test was performed on three test specimens. A low-temperature SSC resistance test was performed on the other three test specimens. Note that the axial direction of each test specimen was parallel to the rolling direction.

The normal-temperature SSC resistance test was performed as follows. Tensile stress was applied in the axial direction of the round bar test specimens of Test Numbers 3-1 to 3-25. At this time, the applied stress was adjusted so as to be 90% of the actual yield stress of each steel plate. A mixed aqueous solution containing 5.0 mass % of sodium chloride and 0.5 mass % of acetic acid (NACE solution A) was used as the test solution. The test solution at 24° C. was poured into three test vessels, and these were adopted as test baths. The three round bar test specimens to which the stress was applied were immersed individually in mutually different test vessels as the test baths. After each test bath was degassed, $H_2S$ gas at 1 atm was blown into the respective test baths and caused to saturate. The test baths in which the $H_2S$ gas at 1 atm was saturated were held at 24° C. for 720 hours.

After being held for 720 hours, the round bar test specimens of Test Numbers 3-1 to 3-25 were observed to determine whether or not sulfide stress cracking (SSC) had occurred. Specifically, after being held for 720 hours, the round bar test specimens were observed with the naked eye and using a projector with a magnification of ×10. Steel plates for which cracking was not confirmed in all three of the round bar test specimens as the result of the observation were determined as being "E" (Excellent). On the other hand, steel plates for which cracking was confirmed in at least one round bar test specimen were determined as being "NA" (Not Acceptable).

The low-temperature SSC resistance test was performed in accordance with "Method A" specified in NACE TM0177-2005, in a similar manner to the normal-temperature SSC resistance test. In the low-temperature SSC resistance test, the applied stress was adjusted so as to be 80% of the actual yield stress of each steel plate. In a similar manner to the normal-temperature SSC resistance test, NACE solution A was used as the test solution. In addition, the temperature of the test bath was made 4° C. The other conditions were the same as in the normal-temperature SSC resistance test.

After being held for 720 hours, the round bar test specimens of Test Numbers 3-1 to 3-25 were observed to determine whether or not sulfide stress cracking (SSC) had occurred. Specifically, after being held for 720 hours, the round bar test specimens were observed with the naked eye and using a projector with a magnification of ×10. Steel plates for which cracking was not confirmed in all three of the round bar test specimens as the result of the observation were determined as being "E" (Excellent). On the other hand, steel plates for which cracking was confirmed in at least one round bar test specimen were determined as being "NA" (Not Acceptable).

[Test Results]

The test results are shown in Table 6.

Referring to Table 5 and Table 6, the chemical composition of the respective steel plates of Test Numbers 3-1 to 3-15 was appropriate, Fn1 was 3.00 or less, and the yield strength was within the range of 862 to 965 MPa (125 ksi grade). In addition, the dislocation density ρ was within a range of $3.0\times10^{14}$ to $7.0\times10^{14}$ ($m^{-2}$), and the number density of coarse precipitates was not more than 0.150 (particles/$\mu m^2$). As a result, the aforementioned steel plates exhibited excellent SSC resistance in the normal-temperature SSC resistance test and in the low-temperature SSC resistance test.

In contrast, in the steel plates of Test Numbers 3-16 and 3-17, Fn1 was more than 3.00. Consequently, the number density of coarse precipitates was more than 0.150 (particles/$\mu m^2$). As a result, the steel plates of Test Numbers 3-16 and 3-17 did not exhibit excellent SSC resistance in the low-temperature SSC resistance test.

In the steel plate of Test Number 3-18, the Cr content was too high. In addition, Fn1 was more than 3.00. Consequently, the number density of coarse precipitates was more than 0.150 (particles/$\mu m^2$). As a result, the steel plate of Test Number 3-18 did not exhibit excellent SSC resistance in the low-temperature SSC resistance test.

For the steel plate of Test Number 3-19, a low-temperature tempering process was performed after performing a high-temperature tempering process. Consequently, the dislocation density ρ was more than $7.0\times10^{14}$ ($m^{-2}$). As a result, the steel plate of Test Number 3-19 did not exhibit excellent SSC resistance in the low-temperature SSC resistance test.

For the steel plate of Test Number 3-20, a low-temperature tempering process was not performed. Consequently, the dislocation density ρ was more than $7.0\times10^{1}$ ($m^{-2}$). As a result, the steel plate of Test Number 3-20 did not exhibit excellent SSC resistance in the low-temperature SSC resistance test.

In the steel plate of Test Number 3-21, the Cr content was too high. In addition, Fn1 was more than 3.00. Furthermore, a low-temperature tempering process was not performed. Consequently, the number density of coarse precipitates was more than 0.150 (particles/$\mu m^2$). In addition, the dislocation density ρ was more than $7.0\times10^{14}$ ($m^{-2}$). As a result, the steel plate of Test Number 3-21 did not exhibit excellent SSC resistance in the low-temperature SSC resistance test.

In the steel plate of Test Number 3-22, the Mn content was too high. As a result, the steel plate of Test Number 3-22 did not exhibit excellent SSC resistance in both the normal-temperature SSC resistance test and the low-temperature SSC resistance test.

In the steel plate of Test Number 3-23, the Cr content was too low. As a result, the steel plate of Test Number 3-23 did not exhibit excellent SSC resistance in both the normal-temperature SSC resistance test and the low-temperature SSC resistance test.

In the steel plate of Test Number 3-24, the Mo content was too low. In addition, Fn1 was more than 3.00. Consequently, the number density of coarse precipitates was more than 0.150 (particles/$\mu m^2$). As a result, the steel plate of Test Number 3-24 did not exhibit excellent SSC resistance in both the normal-temperature SSC resistance test and the low-temperature SSC resistance test.

In the steel plate of Test Number 3-25, the C content was too high. Consequently, the number density of coarse precipitates was more than 0.150 (particles/$\mu m^2$). As a result, the steel plate of Test Number 3-25 did not exhibit excellent SSC resistance in the low-temperature SSC resistance test.

An embodiment of the present invention has been described above. However, the embodiment described above is merely an example for implementing the present invention. Accordingly, the present invention is not limited to the above embodiment, and the above embodiment can be appropriately modified and performed within a range that does not deviate from the gist of the present invention.

INDUSTRIAL APPLICABILITY

The steel material according to the present invention is widely applicable to steel materials to be utilized in a severe environment such as a polar region, and preferably can be utilized as a steel material that is utilized in an oil well environment, and further preferably can be utilized as a steel material for casing, tubing or line pipes or the like.

The invention claimed is:

1. A steel material comprising a chemical composition consisting of, in mass %, C: 0.20 to 0.35%, Si: 0.05 to 1.00%, Mn: 0.01 to 1.00%, P: 0.025% or less, S: 0.0100% or less, Al: 0.005 to 0.100%, Cr: 0.25 to 0.80%, Mo: 0.20 to 2.00%, Ti: 0.002 to 0.050%, B: 0.0001 to 0.0050%, N: 0.0020 to 0.0100%, O: 0.0100% or less, V: 0 to 0.60%, Nb: 0 to 0.030%, Ca: 0 to 0.0100%, Mg: 0 to 0.0100%, Zr: 0 to 0.0100%, Co: 0 to 0.50%, W: 0 to 0.50%, Ni: 0 to 0.50%, Cu: 0 to 0.50%, and rare earth metal: 0 to 0.0100%, with the balance being Fe and impurities, and satisfying Formula (1), wherein in the steel material, a number density of precipitates having an equivalent circular diameter of 400 nm or more in the steel material is 0.150 particles/$\mu m^2$ or less, a yield strength is within a range of 655 to 965 MPa, and a dislocation density p is $7.0\times10^{14}$ $m^{-2}$ or less, in a case where the yield strength is within a range of 655 to less than 758 MPa, the dislocation density p is $1.4\times10^{14}$ $m^{-2}$ or less, in a case where the yield strength is within a range of 758 to less than 862 MPa, the dislocation density p is within a range of more than $1.4\times10^{14}$ to less than $3.0\times10^{14}$ $m^{-2}$, in a case where the yield strength is within a range of 862 to 965 MPa, the dislocation density p is within a range of $3.0\times10^{14}$ to $7.0\times10^{14}$ $m^{-2}$:

$5\times Cr-Mo-2\times(V+Ti)\leq 3.00$ (1)

where, a content of a corresponding element in mass % is substituted for each symbol of an element in Formula (1), and if a corresponding element is not contained, "0" is substituted for the symbol of the relevant element.

2. The steel material according to claim 1, wherein the chemical composition contains one or more elements selected from the group consisting of:

V: 0.01 to 0.60%, and

Nb: 0.002 to 0.030%.

3. The steel material according to claim 1, wherein the chemical composition contains one or more elements selected from the group consisting of:

Ca: 0.0001 to 0.0100%,

Mg: 0.0001 to 0.0100%, and

Zr: 0.0001 to 0.0100%.

4. The steel material according to claim 1, wherein the chemical composition contains one or more elements selected from the group consisting of:

Co: 0.02 to 0.50%, and

W: 0.02 to 0.50%.

5. The steel material according to claim 1, wherein the chemical composition contains one or more elements selected from the group consisting of:

Ni: 0.01 to 0.50%, and

Cu: 0.01 to 0.50%.

6. The steel material according to claim 1, wherein the chemical composition contains:

rare earth metal: 0.0001 to 0.0100%.

7. The steel material according to claim 1, wherein:

the yield strength is within a range of 655 to less than 758 MPa, and the dislocation density p is $1.4\times10^{14}$ $m^{-2}$ or less.

8. The steel material according to claim 1, wherein:

the yield strength is within a range of 758 to less than 862 MPa, and the dislocation density p is within a range of more than $1.4\times10^{14}$ to less than $3.0\times10^{14}$ $m^{-2}$.

9. The steel material according to claim 1, wherein:

the yield strength is within a range of 862 to 965 MPa, and the dislocation density p is within a range of $3.0\times10^{14}$ to $7.0\times10^{14}$ $m^{-2}$.

10. The steel material according to claim 1, wherein:

the steel material is an oil-well steel pipe.

* * * * *